US010274210B2

(12) United States Patent
Wintemute

(10) Patent No.: US 10,274,210 B2
(45) Date of Patent: Apr. 30, 2019

(54) HEAT PUMP HUMIDIFIER AND DEHUMIDIFIER SYSTEM AND METHOD

(75) Inventor: David Martin Wintemute, Montreal (CA)

(73) Assignee: Nortek Air Solutions Canada, Inc., Saskatoon (CA)

( * ) Notice: Subject to any disclaimer, the term of this patent is extended or adjusted under 35 U.S.C. 154(b) by 1803 days.

(21) Appl. No.: 12/870,545

(22) Filed: Aug. 27, 2010

(65) Prior Publication Data

US 2012/0047923 A1 Mar. 1, 2012

(51) Int. Cl.

| | |
|---|---|
| ***F25B 49/02*** | (2006.01) |
| ***F24F 1/022*** | (2019.01) |
| ***F24F 3/147*** | (2006.01) |
| *F24F 11/83* | (2018.01) |

(52) U.S. Cl.

CPC ..... *F24F 1/022* (2013.01); *F24F 3/147* (2013.01); *F24F 11/83* (2018.01)

(58) Field of Classification Search

CPC ..... F25B 49/02; F25B 15/16; F25B 25/02; F24F 2203/026; F24F 3/1423; F24F 2203/10; F24F 3/147; F24F 5/0014; F24F 5/001; F24F 2203/021; F24F 2203/104; F24F 1/022; F24F 11/008; Y02B 30/52

USPC ... 62/92, 93, 91, 94, 271, 150, 324.5, 238.1; 165/59, 222

See application file for complete search history.

(56) References Cited

U.S. PATENT DOCUMENTS

| | | | |
|---|---|---|---|
| 2,186,844 | A | 1/1940 | Smith |
| 2,562,811 | A | 7/1951 | Muffly |
| 2,946,201 | A | 7/1960 | Munters |
| 2,968,165 | A | 1/1961 | Norback |
| 3,009,684 | A | 11/1961 | Munters |
| 3,247,679 | A | 4/1966 | Meckler |
| 3,401,530 | A | 9/1968 | Meckler |
| 3,918,268 | A | 11/1975 | Nussbaum |
| 4,113,004 | A | 9/1978 | Rush et al. |

(Continued)

FOREIGN PATENT DOCUMENTS

| | | | |
|---|---|---|---|
| CA | 28439837 | A1 | 9/2014 |
| CA | 2843987 | C | 5/2017 |

(Continued)

OTHER PUBLICATIONS

Acker; "Industrial Dehumidification: Water Vapor Load Calculations and System Descriptions"; HPAC Heating/Piping/Air Conditioning; Mar. 1999; pp. 49-59.

(Continued)

*Primary Examiner* — Frantz F Jules

*Assistant Examiner* — Martha Tadesse

(74) *Attorney, Agent, or Firm* — Schwegman Lundberg & Woessner, P.A.

(57) ABSTRACT

A heat pump system for conditioning outside air supplied to a building is provided. The system includes a pre-processing module that receives and cools air when the system is operating in a summer mode. A supply air heat exchanger is in flow communication with the pre-processing module. The supply air heat exchanger receives and cools air from the pre-processing module in the summer mode. A processing module is in flow communication with the supply air heat exchanger. The processing module receives and dehumidifies saturated air from the supply air heat exchanger in the summer mode.

19 Claims, 16 Drawing Sheets

(56) References Cited

U.S. PATENT DOCUMENTS 4,157,649 A 6/1979 Bussjager et al.
4,180,985 A 1/1980 Northrup, Jr.
4,235,081 A 11/1980 Dowling
4,356,703 A 11/1982 Vogel
4,474,021 A * 10/1984 Harband ..... F24F 3/1423 62/271
4,594,860 A 6/1986 Coellner et al.
4,719,761 A 1/1988 Cromer
4,729,774 A 3/1988 Cohen et al.
4,887,438 A 12/1989 Meckler
4,903,503 A 2/1990 Meckler
4,936,107 A 6/1990 Kitagaki et al.
4,982,575 A 1/1991 Besik
5,003,961 A 4/1991 Besik
5,148,374 A 9/1992 Coellner
5,170,633 A 12/1992 Kaplan
5,176,005 A 1/1993 Kaplan
5,325,676 A 7/1994 Meckler
5,337,574 A * 8/1994 Dick ..... F24F 1/022 62/89
5,351,497 A 10/1994 Lowenstein
5,353,606 A 10/1994 Yoho et al.
5,373,704 A 12/1994 McFadden
5,448,895 A * 9/1995 Coellner ..... F24F 3/1411 62/271
5,496,397 A 3/1996 Fischer et al.
5,502,975 A 4/1996 Brickley et al.
5,517,828 A * 5/1996 Calton ..... F24F 3/1411 62/271
5,526,651 A 6/1996 Worek et al.
5,533,568 A 7/1996 Schuster et al.
5,538,072 A 7/1996 Burkhart et al.
5,542,968 A 8/1996 Belding
5,551,245 A 9/1996 Calton et al.
5,564,281 A * 10/1996 Calton ..... F24F 3/1411 62/271
5,579,647 A 12/1996 Calton et al.
5,580,369 A 12/1996 Belding
5,632,954 A 5/1997 Coellner et al.
5,638,900 A 6/1997 Lowenstein
5,649,428 A 7/1997 Calton et al.
5,650,221 A 7/1997 Belding
5,660,048 A 8/1997 Belding et al.
5,685,897 A 11/1997 Belding
5,701,762 A 12/1997 Akamatsu et al.
5,727,394 A 3/1998 Belding et al.
5,749,230 A 5/1998 Coellner et al.
5,758,508 A 6/1998 Belding et al.
5,761,915 A 6/1998 Rao
5,761,923 A 6/1998 Maeda
5,791,153 A 8/1998 Belding et al.
5,816,065 A 10/1998 Macda
5,825,641 A 10/1998 Mangtani
5,826,434 A 10/1998 Belding et al.
5,860,284 A 1/1999 Goland
5,890,372 A 4/1999 Belding et al.
5,931,016 A 8/1999 Yoho, Sr.
5,943,874 A 8/1999 Macda
5,992,160 A 11/1999 Bussjager et al.
6,003,327 A 12/1999 Belding et al.
6,018,953 A 2/2000 Belding et al.
6,029,462 A * 2/2000 Denniston ..... B01D 53/06 62/244
6,029,467 A 2/2000 Moratalla
6,050,100 A * 4/2000 Belding ..... B01D 53/06 62/271
6,079,481 A 6/2000 Lowenstein
6,094,835 A 8/2000 Cromer
6,141,979 A 11/2000 Dunlap
6,176,101 B1 1/2001 Lowenstein
6,178,762 B1 1/2001 Flax
6,199,388 B1 * 3/2001 Fischer, Jr. ..... F24F 3/1411 62/271
6,199,392 B1 * 3/2001 Maeda ..... F24F 3/1411 165/6
6,209,622 B1 4/2001 Lagace et al.
6,233,951 B1 5/2001 Cardill
6,237,354 B1 5/2001 Cromer
6,247,323 B1 * 6/2001 Maeda ..... F24F 3/1423 62/271
6,269,650 B1 8/2001 Shaw
6,276,158 B1 8/2001 Lowes et al.
6,318,106 B1 * 11/2001 Maeda ..... F24F 3/1423 62/238.3
RE37,464 E 12/2001 Meckler
6,363,218 B1 3/2002 Lowenstein
6,442,951 B1 9/2002 Maeda et al.
6,568,466 B2 5/2003 Lowenstein
6,575,228 B1 6/2003 Ragland et al.
6,644,059 B2 11/2003 Maeda et al.
6,720,990 B1 4/2004 Walker et al.
6,745,826 B2 6/2004 Lowenstein
6,751,964 B2 6/2004 Fischer
6,848,265 B2 2/2005 Lowenstein
6,918,263 B2 * 7/2005 Lee ..... F24F 3/1423 62/271
6,973,795 B1 12/2005 Moffitt
7,013,655 B2 * 3/2006 Des Champs ..... F24F 5/00 62/298
7,017,356 B2 3/2006 Moffitt
7,089,754 B2 8/2006 Chin et al.
7,092,006 B2 8/2006 Walker et al.
7,171,817 B2 2/2007 Birgen
7,178,355 B2 2/2007 Moffitt
7,213,407 B2 5/2007 Hu
7,231,967 B2 * 6/2007 Haglid ..... B25B 27/0035 165/231
7,269,966 B2 9/2007 Lowenstein
7,306,650 B2 12/2007 Slayzak
7,340,906 B2 3/2008 Moffitt
7,389,646 B2 6/2008 Moffitt
7,461,515 B2 12/2008 Wellman et al.
7,593,033 B2 9/2009 Walker et al.
7,602,414 B2 10/2009 Walker et al.
7,605,840 B2 10/2009 Walker et al.
7,614,249 B2 11/2009 Hu
7,719,565 B2 5/2010 Walker et al.
7,817,182 B2 10/2010 Walker et al.
7,883,024 B2 2/2011 Nakayama et al.
7,966,841 B2 6/2011 Lowenstein
8,091,372 B1 1/2012 Ekern
8,915,092 B2 12/2014 Gerber et al.
9,772,124 B2 9/2017 Wintemute et al.
9,885,486 B2 2/2018 Wintemute
9,920,960 B2 3/2018 Gerber et al.
2002/0129614 A1 * 9/2002 Dinnage ..... F24F 3/1423 62/271
2004/0000399 A1 1/2004 Gavula
2004/0123616 A1 7/2004 Lee et al.
2004/0134211 A1 7/2004 Lee et al.
2005/0257557 A1 11/2005 Chin et al.
2005/0262862 A1 * 12/2005 Moffitt ..... F24F 3/1423 62/271
2005/0279117 A1 12/2005 Choi et al.
2006/0144060 A1 7/2006 Birgen
2007/0095519 A1 5/2007 Hombucher
2007/0137238 A1 6/2007 Hu
2008/0078198 A1 4/2008 Breiding et al.
2010/0170655 A1 * 7/2010 Kronvall ..... F24D 5/12 165/59
2010/0218528 A1 9/2010 Yakumaru et al.
2010/0229575 A1 9/2010 Shaw
2010/0242507 A1 * 9/2010 Meckler ..... F24F 3/1423 62/94
2010/0251742 A1 10/2010 Tucker et al.
2010/0307175 A1 * 12/2010 Teige ..... F24F 3/1423 62/94
2010/0319370 A1 12/2010 Kozubal
2011/0289952 A1 12/2011 Kim et al.
2011/0289956 A1 12/2011 Shah
2011/0308265 A1 12/2011 Phannavong

(56) References Cited

U.S. PATENT DOCUMENTS

| | | | | |
|---|---|---|---|---|
| 2012/0055460 | A1 | 3/2012 | Lambertson | |
| 2012/0085112 | A1 | 4/2012 | Wintemute | |
| 2012/0111042 | A1 | 5/2012 | Hamada et al. | |
| 2012/0125020 | A1 | 5/2012 | Vandermeulen | |
| 2012/0125021 | A1 | 5/2012 | Vandermeulen | |
| 2012/0125029 | A1 | 5/2012 | Moreau | |
| 2012/0125031 | A1 | 5/2012 | Vandermeulen | |
| 2012/0125405 | A1 | 5/2012 | Vandermeulen | |
| 2012/0125581 | A1 | 5/2012 | Allen | |
| 2012/0131934 | A1 | 5/2012 | Vandermeulen | |
| 2012/0131937 | A1 | 5/2012 | Vandermeulen | |
| 2012/0131938 | A1 | 5/2012 | Vandermeulen | |
| 2012/0131939 | A1 | 5/2012 | Vandermeulen | |
| 2012/0131940 | A1 | 5/2012 | Vandermeulen | |
| 2012/0132513 | A1 | 5/2012 | Vandermeulen | |
| 2012/0180505 | A1* | 7/2012 | Gerber | F24D 5/12 62/82 |
| 2012/0186281 | A1 | 7/2012 | Vandermeulen | |
| 2014/0260368 | A1 | 9/2014 | Wintemute et al. | |
| 2018/0031281 | A1 | 2/2018 | Wintemute et al. | |

FOREIGN PATENT DOCUMENTS

| | | | |
|---|---|---|---|
| CN | 101701739 | A | 5/2010 |
| CN | 101900378 | A | 12/2010 |
| CN | 105202795 | A | 12/2015 |
| EP | 2397787 | A2 | 12/2011 |
| GB | 2015384 | A | 9/1979 |
| JP | 05157282 | A | 6/1993 |
| JP | 07310964 | A | 11/1995 |
| JP | 09196482 | A | 7/1997 |
| JP | 2004-257588 | A | 9/2004 |
| JP | 2006308241 | A | 11/2006 |
| JP | 2006336999 | A | 12/2006 |
| JP | 2008304150 | A | 12/2008 |
| WO | WO 96 41107 | | 12/1996 |
| WO | WO 99 14535 | | 3/1999 |
| WO | WO-01/71260 | A1 | 9/2001 |
| WO | WO-2009/000974 | A1 | 12/2008 |
| WO | WO-2012/097445 | A1 | 7/2012 |

OTHER PUBLICATIONS

ASHRAE Technical Committee; Meeting Programs; Jan. 29, 1997 to Jan. 25, 2001 (13 pages).

Bellia et al.; "Air Conditioning Systems With Desiccant Wheel for Italian Climates"; International Journal on Architectural Science; vol. 1; No. 4; 2000; (pp. 193-213).

Chant et al.; "A Steady-State Simulation Of An Advanced Desiccant-Enhanced Cooling and Dehumidification System"; ASHRAE Transactions: Research; Jul. 1992; pp. 339-347.

Coad; "Conditioning Ventilation Air for Improved Performance and Air Quality"; HPAC Heating/Piping/Air Conditioning; Sep. 1999; pp. 49-56.

Des Champs Laboratories, Inc.; "Dehumidification Solutions"; 2001; (18 pages).

Des Champs Technologies; "Desi-Wringer™ Precision Desiccant Dehumidification Systems"; 2007; (12 pages).

DiBlasio; "Desicants in Hospitals—Conditioning A Research Facility"; Engineered Systems; Sep. 1995; (4 pages).

Downing et al.; "Operation and Maintenance for Quality Indoor Air"; Proceedings of the 7th Symposium On Improving Building Systems in Hot and Humid Climates, Ft. Worth, TX; Oct. 9-10, 1990; (5 pages).

Downing; "Humidity Control—No Place Like Home"; Engineered Systems; 1996; (4 pages).

Federal Technology Alert; "Two-Wheel Desiccant Dehumidification System—Technology for Dehumidification and Improving Indoor Air Quality"; Apr. 1997 (24 pages).

Fischer; "Active Desiccant Dehumidification Module Integration With Rooftop Packaged HVAC Units—Final Report Phase 3B"; Oak Ridge National Laboratory; Mar. 2002; (36 pages).

Fischer; "Optimizing IAQ, Humidity Control, and Energy Efficiency In School Environments Through The Application Of Desiccant-Based Total Energy Recovery Systems"; IAQ 96/Paths to Better Building Environments/Environmental Effects on Health and Productivity; Date unknown (pp. 179-194).

Harriman, III et al.; "Dehumidification and Cooling Loads From Ventilation Air"; ASHRAE Journal; Nov. 1997; (pp. 37-45).

Harrimann, III et al.; "New Weather Data for Energy Calculations"; ASHRAE Journal; Mar. 1999; (pp. 31-38).

Harriman, III et al.; "Evaluating Active Desiccant Systems For Ventilating Commercial Buildings"; ASHRAE Journal; Oct. 1999; (pp. 25-34).

"Heating, Ventilating, and Air Conditioning (HVAC) Demonstration"; Chapter 8—HVAC Demonstration; (pp. 65-77 and 157-158).

Jeong et al.; "Energy Conservation Benefits of a Dedicated Outdoor Air System with Parallel Sensible Cooling By Ceiling Radiant Panels"; ASHRAE Transactions; vol. 109; Part 2; 2003; (10 pages).

Kosar et al.; "Dehumidification Issues of Standard 62-1989"; ASHARE Journal; Mar. 1998; (pp. 71-75).

AAONAIRE Energy Recovery Units Users Information Manual.

Mc Gahey; "New Commercial Applications for Desiccant-Based Cooling"; ASHARE Journal; Jul. 1998; (pp. 41-45).

Mc Gahey et al.; "Desiccants: Benefits for the Second Century of Air Conditioning"; Proceedings of the Tenth Symposium On Improving Building Systems in Hot and Humid Climates, Ft. Worth, Texas; May 13-14, 1996 (9 pages).

Mumma et al.; "Achieving Dry Outside Air in an Energy-Efficient Manner"; ASHRAE Transactions 2001; vol. 107; Part 1; (8 pages).

Mumma; "Dedicated Outdoor Air-Dual Wheel System Control Requirements"; ASHRAE Transactions 2001; vol. 107; Part 1; (9 pages).

Mumma et al.; "Extension of the Multiple Spaces Concept of ASHRAE Standard 62 to Include Infiltration, Exhaust/Exfiltration, Interzonal Transfer, and Additional Short-Circuit Paths"; ASHRAE Transactions: Symposia; Date Unknown; (pp. 1232-1241).

Mumma; "Overview of Integrating Dedicated Outdoor Air Systems With Parallel Terminal Systems"; ASHRAE Transactions 2001; vol. 107; Part 1; (7 pages).

Nimmo et al.; "DEAC: Desiccant Enhancement of Cooling-Based Dehumidification"; ASHRAE Transactions: Symposia; Date Unknown; (pp. 842-848).

Qin et al.; "Engine-driven Desiccant-assisted Hybrid Air-conditioning System"; 23rd World Gas Conference, Amsterdam 2006 (15 pages).

Scofield et al.; "HVAC Design for Classrooms: Divide and Conquer"; Heating/Piping/Air Conditioning; May 1993 (pp. 53-59).

"Energy Recovery—Fresh In Air Quality"; SEMCO Inc.; Date Unknown (131 pages).

Sevigny et al.; "Air Handling Unit Direct Digital Control System Retrofit To Provide Acceptable Indoor Air Quality And Global Energy Optimization"; Energy Engineering; vol. 94; No. 5; 1997; (pp. 24-43).

Shank et al.; "Selecting the Supply Air Conditions for a Dedicated Outdoor Air System Working in Parallel with Distributed Sensible Cooling Terminal Equipment"; ASHRAE Transactions 2001; vol. 107; Part 1; (10 pages).

Smith et al.; "Outdoor Air, Heat Wheels and JC Penny: A New Approach to Retail Ventilation"; Proceedings of the Eleventh Symposium On Improving Building Systems In Hot and Humid Climates, Ft. Worth, Texas; Jun. 1-2, 1998 (pp. 311).

Smith; "Schools Resolve IAQ/Humidity Problems with Desiccant Preconditioning"; Heating/Piping/Air Conditioning; Apr. 1996; (6 pages).

Swails et al.; "A Cure for Growing Pains"; www.csermag.com; Consulting Specifying Engineer; Jun. 1997 (4 pages).

"Advances in Desiccant-Based Dehumidification"; TRANE Engineers Newsletter; vol. 34-4; Date Unknown; (pp. 1-8).

Turpin; "Dehumidification: The Problem No One Wants To Talk About (Apr. 2000)"; http//www.esmagazine.com/copyright/de12c1c879ba8010VgnVCM100000f932a8c0_? . . . ; May 6, 2011 (6 pages).

Yborra; "Field Evaluation of Desiccant-Integrated HVAC Systems: A Review of Case Studies in Multiple Commercial/Institutional

(56) References Cited

OTHER PUBLICATIONS

Building Types"; Proceedings of the Eleventh Symposium On Improving Building Systems In Hot and Humid Climates, Ft. Worth, Texas; Jun. 1-2, 1998;(pp. 361-370).
"Performance analysis of a liquid desiccant and membrane contactor hybrid air-conditioning system," Bergero, Chiari, Energy and Buildings, 2010.
"AAONAIRE Energy Recovery Units Users Information Manual", (Aug. 2006), 16 pgs.
"U.S. Appl. No. 13/275,633, Advisory Action dated Jul. 13, 2015", 4 pgs.
"U.S. Appl. No. 13/275,633, Advisory Action dated Nov. 17, 2016", 3 pgs.
"U.S. Appl. No. 13/275,633, Appeal Brief filed Feb. 27, 2017", 29 pgs.
"U.S. Appl. No. 13/275,633, Appeal Brief filed Jun. 16, 2014", 22 pgs.
"U.S. Appl. No. 13/275,633, Appeal Brief flied Aug. 27, 2015", 22 pgs.
"U.S. Appl. No. 13/275,633, Decision on Pre-Appeal Brief Request dated Aug. 20, 2015", 2 pgs.
"U.S. Appl. No. 13/275,633, Final Office Action dated Apr. 14, 2014", 15 pgs.
"U.S. Appl. No. 13/275,633, Final Office Action dated May 6, 2015", 14 pgs.
"U.S. Appl. No. 13/275,633, Final Office Action dated Jul. 29, 2016", 14 pgs.
"U.S. Appl. No. 13/275,633, Non Final Office Action dated Feb. 12, 2016", 12 pgs.
"U.S. Appl. No. 13/275,633, Non Final Office Action dated Aug. 29, 2014", 15 pgs.
"U.S. Appl. No. 13/275,633, Non Final Office Action dated Dec. 20, 2013", 12 pgs.
"U.S. Appl. No. 13/275,633, Pre-Brief Conference Request filed Jul. 21, 2015", 5 pgs.
"U.S. Appl. No. 13/275,633, Response filed Jan. 30, 2014 to Non Final Office Action dated Dec. 20, 2013", 12 pgs.
"U.S. Appl. No. 13/275,633, Response filed May 11, 2016 to Non Final Office Action dated Feb. 12, 2016", 11 pgs.
"U.S. Appl. No. 13/275,633, Response filed Jul. 2, 2015 to Final Office Action dated May 6, 2015", 11 pgs.
"U.S. Appl. No. 13/275,633, Response filed Oct. 2, 2013 to Restriction Requirement dated Sep. 12, 2013", 2 pgs.
"U.S. Appl. No. 13/275,633, Response filed Oct. 28, 2016 to Final Office Action dated Jul. 29, 2018", 16 pgs.
"U.S. Appl. No. 13/275,633, Response filed Nov. 3, 2014 to Non Final Office Action dated Aug. 29, 2014", 10 pgs.
"U.S. Appl. No. 13/275,633, Restriction Requirement dated Sep. 13, 2013", 10 pgs.
"U.S. Appl. No. 13/350,902, Appeal Brief filed Apr. 4, 2014", 24 pgs.
"U.S. Appl. No. 13/350,902, Appeal Decision dated Sep. 30, 2016", 6 pgs.
"U.S. Appl. No. 13/350,902, Examiner's Answer dated Jun. 16, 2016", 17 pgs.
"U.S. Appl. No. 13/350,902, Final Office Action dated Dec. 30, 2013", 13 pgs.
"U.S. Appl. No. 13/350,902, Non Final Office Action dated Oct. 1, 2013", 13 pgs.
"U.S. Appl. No. 13/350,902, Notice of Allowance dated Mar. 1, 2017", 7 pgs.
"U.S. Appl. No. 13/350,902, Notice of Allowance dated Nov. 9, 2016", 9 pgs.
"U.S. Appl. No. 13/350,902, Reply Brief filed Jul. 8, 2014", 9 pgs.
"U.S. Appl. No. 13/350,902, Response filed Aug. 5, 2013 to Restriction Requirement dated Jul. 23, 2013", 2 pgs.
"U.S. Appl. No. 13/350,902, Response filed Oct. 29, 2013 to Non Final Office Action dated Oct. 1, 2013", 15 pgs.
"U.S. Appl. No. 13/350,902, Restriction Requirement dated Jul. 23, 2013", 8 pgs.
"U.S. Appl. No. 14/186,420, Non Final Office Action dated Mar. 11, 2016", 19 pgs.
"U.S. Appl. No. 14/186,420, Non Final Office Action dated May 25, 2016", 21 pgs.
"U.S. Appl. No. 14/186,420, Non Final Office Action dated Sep. 20, 2016", 16 pgs.
"U.S. Appl. No. 14/186,420, Notice of Allowance dated Jan. 27, 2017", 7 pgs.
"U.S. Appl. No. 14/186,420, Response filed Dec. 3, 2015 to Restriction Requirement dated Nov. 20, 2015", 3 pgs.
"U.S. Appl. No. 14/186,420, Response filed Dec. 20, 2016 to Non Final Office Action dated Sep. 20, 2016", 9 pgs.
"U.S. Appl. No. 14/186,420, Restriction Requirement dated Nov. 20, 2015", 6 pgs.
"Australian Application Serial No. 2012208921, First Examiner Report dated Jun. 2, 2016", 7 pgs.
"Canadian Application Serial No. 2,843,987, Office Action dated Aug. 5, 2015", 3 pgs.
"Canadian Application Serial No. 2,843,987, Response filed Feb. 1, 2016 Office Action dated Aug. 5, 2015", 6 pgs.
"Chinese Application serial No. 201280006006.9, Office Action dated Feb. 2, 2016", w/ English Summary), 19 pgs.
"Chinese Application Serial No. 201280006006.9, Response filed Apr. 8, 2016 to Office Action dated Feb. 2, 2016", (w/ English Translation of Claims), 64 pgs.
"Chinese Application Serial No. 201280006006.9, Voluntary Amendment filed Apr. 14, 2014", 61 pgs.
"Chinese Application serial No. 201280006006.9, Office Action dated May 13, 2015", 3 pgs.
"Chinese Application Serial No. 201280006006.9, Office Action dated Aug. 15, 2016", (English Translation), 18 pgs.
"Chinese Application Serial No. 201280006006.9, Response filed Sep. 28, 2015 to Office Action dated May 13, 2015", (w/ English Translation of Claims), 71 pgs.
"Chinese Application Serial No. 201280006006.9, Response filed Dec. 30, 2016 to Office Action dated Aug. 15, 2016", (w/ English Translation of Claims), 69 pgs.
"European Application Serial No. 12736074.1, Extended European Search Report dated Jul. 13, 2015", 8 pgs.
"European Application Serial No. 12736074.1, Response filed Oct. 2, 2015 to Extended European Search Report dated Jul. 13, 2015", 10 pgs.
"International Application serial No. PCT/CA2012/000055, International Preliminary Report on Patentability dated Aug. 1, 2013", 9 pgs.
"International Application Serial No. PCT/CA2012/000055, International Search Report dated May 24, 2012", 4 pgs.
"international Application Serial No. PCT/CA2012/000055, Invitation to Pay Addl Fees and Partial Search Report dated Mar. 23, 2012", 2 pgs.
"International Application Serial No. PCT/CA2012/000055, Written Opinion dated May 24, 2012", 7 pgs.
"International Application Serial No. PCT/CA2012/00055, International Preliminary Report on Patentability dated Aug. 1, 2013", 9 pgs.
"International Application Serial No. PCT/CA2012/00055, International Search Report dated May 24, 2012", 4 pgs.
"International Application Serial No. PCT/CA2012/00055, Written Opinion dated May 24, 2012", 7 pgs.
"U.S. Appl. No. 13/350,902, Notice of Allowance dated Jun. 22, 2017", 7 pgs.
"U.S. Appl. No. 14/186,420, Notice of Allowance dated May 31, 2017", 7 pgs.
"Chinese Application Serial No. 201280006006.9, Decision of Rejection dated May 4, 2017", w/ summary in English, 7 pgs.
"Chinese Application Serial No. 201510655570.9, Office Action dated Apr. 1, 2017", (w/ English Translation), 14 pgs.
"European Application Serial No. 12736074.1, Communication Pursuant to Article 94(3) EPC dated Feb. 9, 2017", 4 pgs.
"U.S. Appl. No. 13/275,633, Corrected Notice of Allowance dated Oct. 26, 2017", 4 pgs.
"U.S. Appl. No. 13/275,633, Notice of Allowance dated Sep. 20, 2017", 10 pgs.

(56) References Cited

OTHER PUBLICATIONS

"U.S. Appl. No. 13/350,902, Corrected Notice of Allowance dated Feb. 6, 2018", 2 pgs.
"U.S. Appl. No. 13/350,902, Notice of Allowance dated Oct. 20, 2017", 7 pgs.
"U.S. Appl. No. 15/710,345, Preliminary Amendment filed Sep. 20, 2017", 3 pgs.
"U.S. Appl. No. 15/710,345, Supplemental Preliminary Amendment filed Feb. 19, 2018", 7 pgs.
"Canadian Application Serial No. 2,823,421, Office Action dated Dec. 15, 2017", 4 pgs.
"Chinese Application Serial No. 201280006006.9, Response filed Aug. 21, 2017 to Decision of Rejection dated May 4, 2017", w/ claims in English, 12 pgs.
"European Application Serial No. 12736074.1, Response filed Aug. 17, 2017 to Communication Pursuant to Article 94(3) EPC dated Feb. 9, 2017", 5 pgs.

* cited by examiner

HEAT PUMP HUMIDIFIER AND DEHUMIDIFIER SYSTEM AND METHOD

BACKGROUND OF THE INVENTION

The subject matter herein relates generally to heat pumps and, more particularly, to a heat pump humidifier and dehumidifier system and method.

Heat pumps are used to condition air supplied to a building or structure. Typically, the supply air passes through a first heat exchanger to adjust a temperature and humidity of the supply air. The supply air is then channeled to a desiccant wheel to humidify or dehumidify the air prior to discharging the air into the space. Return air is utilized to regenerate the desiccant wheel by humidifying or dehumidifying the regeneration air. When the supply air is humidified, the regeneration air is dehumidified. When the supply air is dehumidified, the regeneration air is humidified. Generally, the regeneration air also passes through a second heat exchanger prior to passing through the desiccant wheel. The first and second heat exchangers usually transfer energy between the supply air and the regeneration air.

Typically, the regeneration air is supplied from inside the space. However, inside air generally lacks sufficient energy to properly regenerate the desiccant wheel. Accordingly, known heat pump systems may operate at reduced efficiencies when using outside air to regenerate the desiccant wheel. Because of the reduced efficiency of the heat pump, the heat pump may not be capable of conditioning some outside air. In particular, known heat pumps generally lack the capability of conditioning outside air having extreme hot or extreme cold temperatures.

A need remains for a more efficient heat pump system or method that utilizes the energy of return air to regenerate the desiccant wheel, increase effectiveness of the heat pump and provides considerable humidification load reductions to building operation. Another need remains for a heat pump that pre-processes supply air to enable the heat pump to operate in extreme weather conditions without significant reduction in efficiency.

SUMMARY OF THE INVENTION

In one embodiment, a heat pump system for conditioning air supplied to a space is provided. The system includes a pre-processing module that receives and removes at least one of heat or moisture from the air when the system is operating in a summer mode. A supply air heat exchanger is provided in flow communication with the pre-processing module. The supply air heat exchanger receives air from the pre-processing module and removes at least one of heat or moisture from the air in the summer mode. A processing module is provided in flow communication with the supply air heat exchanger. The processing module receives and at least one of dehumidifies or conditions air from the supply air heat exchanger in the summer mode.

In another embodiment, as heat pump system for conditioning air supplied to a space is provided. The system includes a pre-processing module that receives and adds at least one of heat or moisture to the air when the system is operating in a winter mode. A supply air heat exchanger is provided in flow communication with the pre-processing module. The supply air heat exchanger receives air from the pre-processing module. The supply air heat exchanger heats the air from the pre-processing module in the winter mode. A processing module is provided in flow communication with the supply air heat exchanger. The processing module receives and at least one of humidifies or conditions air from the supply air heat exchanger in the winter mode.

In another embodiment, a heat pump system for conditioning air supplied to a space is provided. The system is configured to operate in both a summer mode and a winter mode. The system includes a supply air heat exchanger configured to operate as an evaporator coil in the summer mode and as a condenser coil in the winter mode. A processing module is provided in flow communication with the supply air heat exchanger to condition air discharged into the space.

In another embodiment, a method of controlling a heat pump system is provided. The method includes receiving air at a pre-processing module and pre-conditioning the air with the pre-processing module. The air is directed to a processing module positioned in flow communication with the pre-processing module. The air is conditioned with the processing module. The system is operated in one of a summer mode and a winter mode. The system humidifies the air during the winter mode and dehumidifies the air during the summer mode. Conditioned supply air is discharged into a space.

In another embodiment, a method for conditioning air supplied to a space is provided. The method includes conditioning air using one of a summer mode or a winter mode, wherein the air is dehumidified in the summer mode and humidified in the winter mode. The method also includes changing an air flow direction of return air between the summer mode and the winter mode.

DETAILED DESCRIPTION OF THE DRAWINGS

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
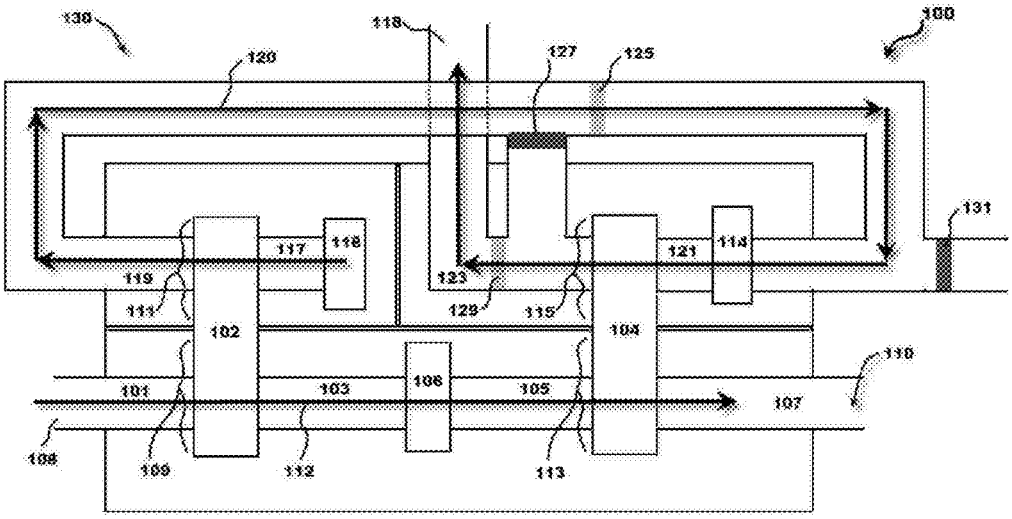
FIG. 1 is a schematic view of a heat pump system formed in accordance with an embodiment and operating in a summer mode.
Figure 2:
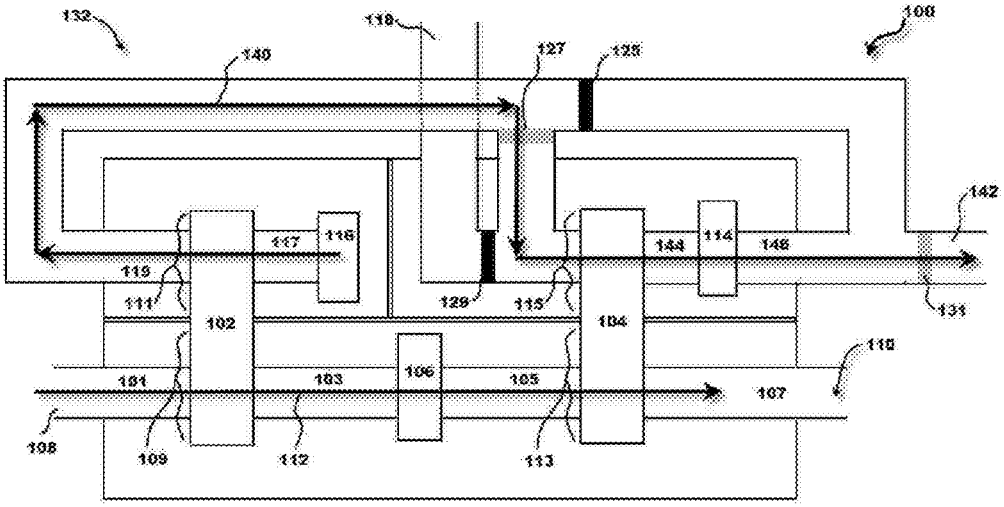
FIG. 2 is a schematic view of the system shown in FIG. 1 operating in a winter mode.

FIG. 1 is a schematic view of a heat pump system 100 formed in accordance with an embodiment and operating in a summer mode 130. FIG. 2 is a schematic view of the system 100 operating in a winter mode 132. The system 100 is configured to condition supply air flowing into a building or space and return air channeled from within the building or space. When in the summer mode 130, among other things, the system 100 dehumidifies the supply air flowing into the building. When in the winter mode 132, among other things, the system 100 humidifies the supply air flowing into the building. The system 100 is capable of switching between the summer mode 130 and the winter mode 132 without the need to reconfigure the components of the system 100.

First, the operation of system 100 is described in connection with the summer mode 130, as illustrated in FIG. 1. In the summer mode 130, the system includes a supply air flow path 112 and a return air flow path 120. The supply air flow path 112 travels between a supply air inlet 108 and a supply air outlet 110. In one embodiment, the system 100 may include at least one fan to draw air into and move air through the supply air flow path 112. Outside air flows through the supply air inlet 108 and into an outside air region 101.

A pre-processing module 102 is positioned downstream of the outside air region 101. In one embodiment, the pre-processing module 102 may include an energy recovery device, such as, an enthalpy wheel, a fixed enthalpy plate, an enthalpy pump and/or any other suitable heat exchanger that transfers both sensible heat and latent heat. In one embodiment the pre-processing module 102 is formed as a fixed body heat exchanger, an air to air heat exchanger, an air to liquid heat exchanger, a liquid to air heat exchanger, or liquid to liquid heat exchanger. The pre-processing module 102 includes a supply air side 109 and a return air side 111. The supply air side 109 is positioned within the supply air flow path 112. The return air side 111 is positioned within the return air flow path 120.

Outside air passes through the supply air side 109 of the pre-processing module 102. The pre-processing module 102 is configured to transfer latent energy and sensible energy between the supply air flow path 112 and the return air flow path 120. The latent energy includes moisture in the flow paths 112 and 120. The pre-processing module 102 transfers heat from a warmer flow path to a cooler flow path. The pre-processing module 102 also transfers humidity from a high humidity flow path to a low humidity flow path. The outside air is cooled as the outside air passes through the pre-processing module 102. The cooled air from the pre-processing module 102 is discharged into a pre-processed air region 103 positioned downstream from the pre-processing modules 102.

A supply air heat exchanger 106 is positioned downstream from the pre-processed air region 103. The supply air heat exchanger 106 operates as an evaporator coil or cooling coil in the summer mode 130. As an evaporator coil, the supply air heat exchanger 106 conditions the cooled air and further removes heat from the cooled air to produce saturated air that is discharged into a conditioned air region 105. The amount of energy required to saturate air is proportional to the temperature and humidity of the air conditions in the pre-processed air region. Generally cooler air requires less energy to become saturated than warmer air. Because the supply air is first cooled by the pre-processing module 102, the energy expended by the supply air heat exchanger 106 to saturate the supply air to the desired saturated conditions is reduced, thereby increasing an efficiency of the supply air heat exchanger 106 as the supply air heat exchanger 106 saturates or cools the air. In the summer mode 130, the system 100 is capable of operating at extreme temperatures. For example, in the summer mode 130, the pre-processing module is capable of conditioning outside air having a dry bulb temperature over 90° F. Additionally, the supply air heat exchanger 106 is capable of conditioning air having a dry bulb temperature over 80° F.

A processing module 104 is positioned downstream from the conditioned air region 105. The saturated air passes through the processing module 104. In one embodiment, the processing module 104 may include a desiccant wheel, liquid desiccant system or any other suitable exchanger that removes and/or transfers moisture from the air. The processing module 104 may utilize any one of, or a combination of drierite, silica gel, calcium sulfate, calcium chloride, montmorillonite clay, activated aluminas, zeolites and/or molecular sieves to absorb moisture in the air. Other components that may also be used by the processing module are halogenated compounds such as halogen salts including chloride, bromide and fluoride salts, to name a few examples. In one embodiment, the processing module 104 is formed as a fixed body heat exchanger, an air to air heat exchanger, an air to liquid heat exchanger, a liquid to air heat exchanger, or liquid to liquid heat exchanger. The processing module 104 includes a supply air side 113 and a return air side 115. The supply air side 113 is positioned within the supply air flow path 112 and the return air side 115 is positioned within the return air flow path 120. The saturated air passes through the supply air side 113 to remove moisture therefrom and produce conditioned supply air that has been further dehumidified. Because the air is first saturated by the supply air heat exchanger 106, the efficiency of the processing module 104 is increased when dehumidifying the air. The dehumidified supply air flows downstream into a processed air region 107. From the processed air region 107, the dehumidified supply air flows through the supply air outlet 110 and into the space.

Air leaves the space at return air inlet 116 and traverses a return air flow path 120. The return air flow path 120 is defined between the return air inlet 116 and a return air outlet 118. In one embodiment, the system 100 may include at least one fan to draw air into and move air through the return air flow path 120. Return air enters through the return air inlet 116 and flows downstream into the return air region 117.

The return air side 111 of the pre-processing module 102 is positioned downstream from the return air region 117. The return air passes through the return air side 111 of the pre-processing module 102. The pre-processing module 102 transfers heat and moisture into the return air passing through the return air side 111, thereby removing heat from the supply air passing through the supply air side 109. The heated air flows into a pre-processed air region 119 and through a series of dampers 125, 127, 129, and 131. In the summer mode 130 dampers 125 and 129 are opened and dampers 127 and 131 are closed to direct the heated air to a return air heat exchanger 114 positioned downstream from the damper 125.

The return air heat exchanger 114 operates as a condenser coil in the summer mode 130 to heat and lower relative humidity of conditioned air. The heat exchanger 114 uses the heat from the supply air heat exchanger 106 to lower relative humidity of the heated air thus increasing the air's capacity to absorb water downstream. The heated air flows into a conditioned air region 121. The lowered relative humidity air in the conditioned air region 121 is channeled downstream to the return air side 115 of the processing module 104.

The lowered relative humidity air passing through the return air side 115 of the processing module 104 regenerates the processing module 104 by receiving moisture from the saturated air in the supply air side 113 and adding humidity to the exhaust air that flows into a processed air region 123. The exhaust air is channeled through the open damper 129, through return air outlet 118, and is exhausted from the space.

In one embodiment, the heat pump system 100 senses a condition of at least one of the supply air or return air from the space to control an output of at least one of the pre-processing module 102, the processing module 104, the supply air heat exchanger 106, and/or the return air heat exchanger 114 to achieve a pre-determined dehumidification in the summer mode 130 and pre-determined humidification in a winter mode 130.

In another embodiment, the heat pump system 100 senses a condition of at least one of the supply or return air from the space to control an output of at least one of pre-processing module 102, the processing module 104, the supply air heat exchanger 106, and/or the return air heat exchanger 114 to achieve a pre-determined performance of the system 100.

In another embodiment, the heat pump system 100 senses a condition of at least one of the supply air or return air from the space to control an output of at least one of the pre-processing module 102, the processing module 104, the supply air heat exchanger 106, and/or the return air heat exchanger 114 to limit frost formation in the pre-processing module 102 and/or the return air heat exchanger 114 in the winter mode 132.

In another embodiment, the heat pump system 100 senses a condition of at least one of the supply air or return air from the space to control an output of at least one of the pre-processing module 102 or the processing module 104.

In another embodiment, at least one of the pre-processing module 102 or processing module 104 is formed as a rotating body. The rotating body is rotated with at least one of a pre-determined speed or a predetermined range to achieve a pre-determined amount of at least one of moisture transfer or heat transfer to limit frost formation in the pre-processing module 102 and/or the return air heat exchanger 114. A rotational speed of at least one of the pre-processing module 102 and/or the processing module 104 may be adjusted to a predetermined range, such that the pre-processing module 102 operates almost as a at least one of a sensible wheel, a enthalpy wheel or a desiccant wheel based on variations in the outside air or return air from the space.

It should be noted that the system 100 is exemplary only and may include any number of pre-processing modules 102, processing modules 104, supply air heat exchangers 106 and/or return air heat exchangers 114. Additionally, the arrangement of the components may be varied. The components described herein are arranged to provide a balance in energy between the supply air flow path 112 and the return air flow path 120.

Figure 3:
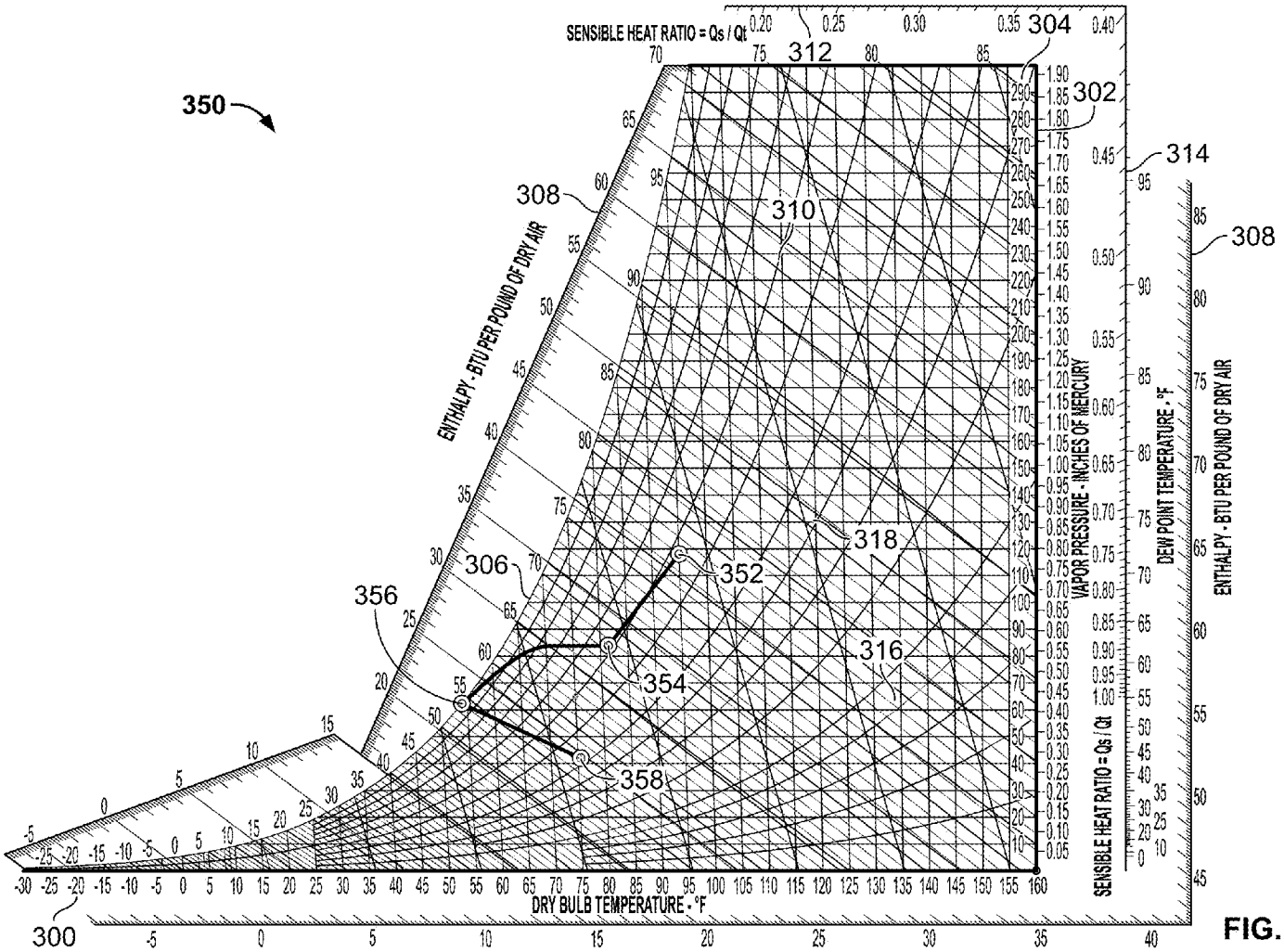
FIG. 3 is a psychrometric chart of the supply air of a heat pump system operating in a summer mode.
Figure 4:
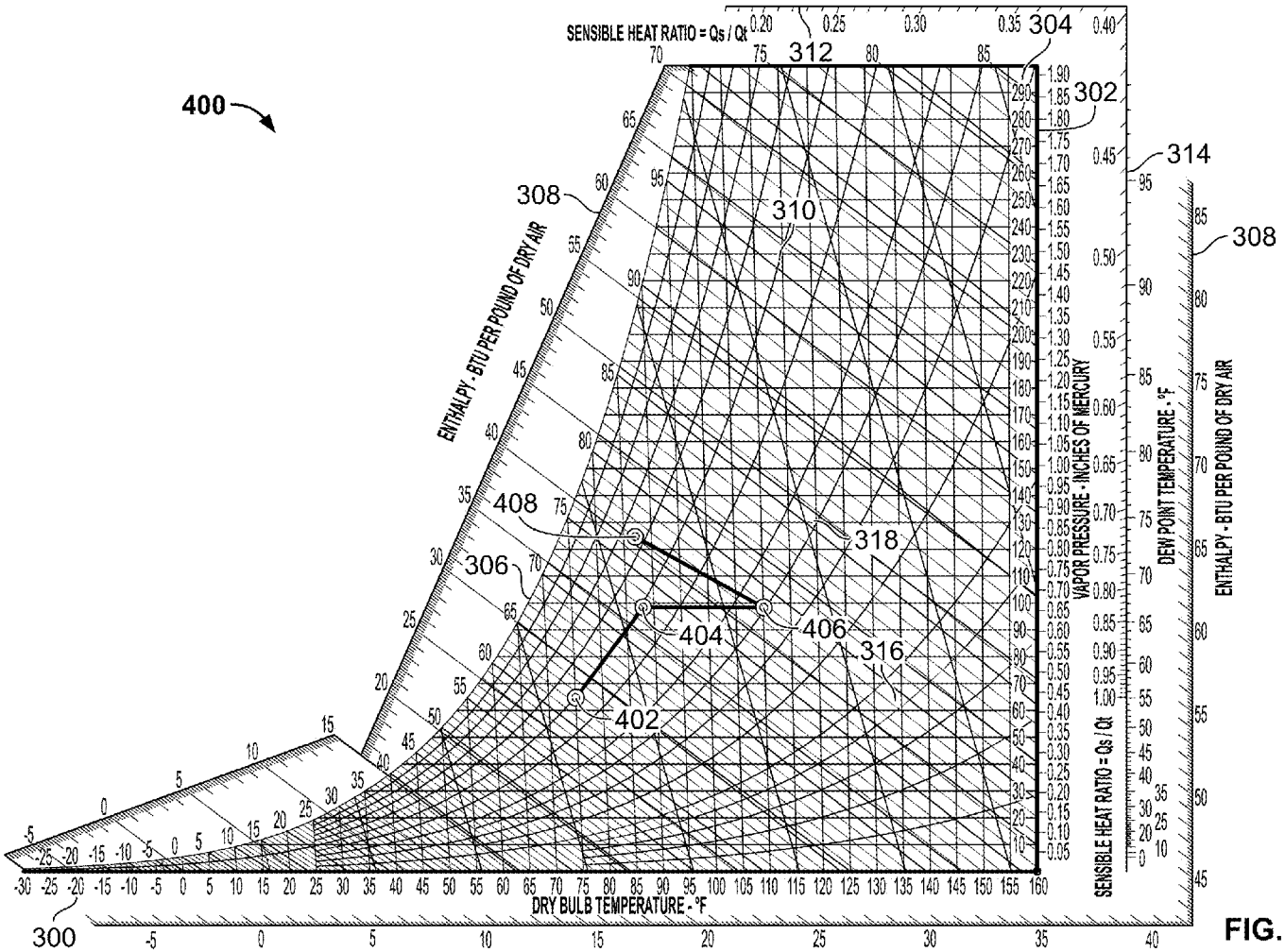
FIG. 4 is a psychrometric chart of the return air of a heat pump system operating in a summer mode.

FIGS. 3 and 4 illustrate psychrometric charts 350 and 400 for the system 100 when operating in the summer mode 130. It should be noted that the charts 350 and 400 are exemplary only and illustrate a single operating point for the summer mode 130 conditions. The charts 350 and 400 include an x-axis 300 that illustrates a dry bulb temperature of the air in degrees Fahrenheit and a y-axis 302 that illustrates vapor pressure in inches of mercury. A second y-axis 304 illustrates a humidity ratio in grains of moisture per pound of dry air. Curve 306 illustrates a saturation point of the air and lines 308 illustrate an enthalpy of the air in BTU per pound of dry air. Lines 310 illustrate a wet bulb temperature of the air in degrees Fahrenheit. A sensible heat ratio is illustrated on line 312 and a dew point temperature in degrees Fahrenheit is illustrated on line 314. A relative humidity of the air is illustrated on curves 316 and a volume of the air in cubic feet per pound of dry air is illustrated on curves 318.

FIG. 3 is a psychrometric chart 350 illustrating the condition of the air in the supply air flow path 112 when the system 100 is operating in the summer mode 130 and when the supply air enters the outside air region 101 at point 352 on chart 350. The supply air has a dry bulb temperature of approximately 95° F. and a wet bulb temperature of approximately 78° F. The enthalpy of the supply air is approximately 42 BTU per pound of dry air and the humidity ratio is approximately 120 grains of moisture per pound of dry air.

The supply air passes through the supply air side 109 of the pre-processing module 102. The pre-processing module 102 cools the supply air to generate cooled air that is discharged into the pre-processed air region 103 of the system 100. Point 354 of chart 350 illustrates the conditions of the cooled air within the pre-processed air region 103. The cooled air has a dry bulb temperature of approximately 80° F. and a wet bulb temperature of approximately 68.5° F. The enthalpy of the cooled air is approximately 33 BTU per pound of dry air and the humidity ratio is approximately 86 grains of moisture per pound of dry air.

The cooled air flows downstream to the supply air heat exchanger 106 and is conditioned to near the saturation curve 306. The supply air heat exchanger 106 operates as an evaporator coil to further reduce the temperature of the cooled air and generate saturated air. The cooled saturated air is discharged into the conditioned air region 105. Point 356 of chart 350 illustrates the conditions of the saturated air within the conditioned air region 105. At point 356 the saturated air has a dry bulb temperature of approximately 52° F. and a wet bulb temperature of approximately 52° F. The enthalpy of the saturated air is approximately 22 BTU per pound of dry air and the humidity ratio is approximately 58 grains of moisture per pound of dry air.

Next the saturated air is channeled through supply air side 113 of the processing module 104. The processing module 104 removes moisture from the saturated air to generate dehumidified supply air within the processed air region 107. Point 358 of chart 350 illustrates the conditions of the supply air. The supply air has a dry bulb temperature of approximately 74° F. and a wet bulb temperature of approximately 57° F. The enthalpy of the supply air is approximately 24.5 BTU per pound of dry air and the humidity ratio is approximately 42 grains of moisture per pound of dry air. The supply air is discharged through the supply air outlet 110 and into the space.

FIG. 4 is a psychrometric chart 400 illustrating the condition of the air in the return air flow path 120 when the system 100 is operating in the summer mode 130. The return air enters the system 100 through the return air inlet 116. Point 402 of chart 400 illustrates the condition of the return air within the return air region 117. The return air has a dry bulb temperature of approximately 74° F. and a wet bulb temperature of approximately 62.5° F. The enthalpy of the return air is approximately 28 BTU per pound of dry air and the humidity ratio is approximately 66 grains of moisture per pound of dry air.

The return air flows through the return air side 111 of the pre-processing module 102. The heat and moisture removed from the supply air on the supply air side 109 of the pre-processing module 102 is transferred into the return air on the return air side 111 of the pre-processing module 102 to generate heated air. The heated air flows into the pre-processed air region 119. Point 404 of chart 400 illustrates the conditions of the heated air. At point 404 the heated air has a dry bulb temperature of approximately 88° F. and a wet bulb temperature of approximately 73° F. The enthalpy of the heated air is approximately 36 BTU per pound of dry air and the humidity ratio is approximately 98 grains of moisture per pound of dry air.

The heated air passes through the return air heat exchanger 114. In the summer mode 130, the return air heat exchanger 114 operates as a condenser coil and transfers the heat from the supply air heat exchanger 106 to the return air flow path 120. The heat exchanger 114 also lowers relative humidity of the air to increase the air's capacity to absorb water downstream. The dry air is discharged into the conditioned air region 121. Point 406 of chart 400 illustrates the conditions of the dry air within the conditioned air region 121. At point 406 the dry air has a dry bulb temperature of approximately 110° F. and a wet bulb temperature of approximately 79° F. The enthalpy of the dry air is approximately 42 BTU per pound of dry air and the humidity ratio is approximately 98 grains of moisture per pound of dry air.

The dry air travels downstream to the return air side 115 of the processing module 104. The processing module 104 transfers moisture from the cooled saturated air in the supply air side 113 to the heated dry air in the return air side 115. Point 408 of chart 400 illustrates the conditions of the exhaust air. The exhaust air has a dry bulb temperature of approximately 87° F. and a wet bulb temperature of approximately 77° F. The enthalpy of the exhaust air is approximately 41 BTU per pound of dry air and the humidity ratio is approximately 125 grains of moisture per pound of dry air. The exhaust air is discharged from the space through the return air outlet 118.

Next, the operation of system 100 is described in connection with the winter mode 132, as illustrated in FIG. 2. In the winter mode 132, the supply air flow path 112 follows the same path as defined in the summer mode 130. In the winter mode 132, the function of the system components may differ from the function of the system components in the summer mode 130.

Outside air flows through the supply air inlet 108 and into the outside air region 101. The outside air in the outside air region 101 travels downstream through the supply air side 109 of the pre-processing module 102. The outside air is heated by the pre-processing module 102 to generate heated and humidified air that is discharged into the pre-processed air region 103.

The heated and humidified air in the pre-processed air region 103 passes through the supply air heat exchanger 106. The supply air heat exchanger 106 operates as a condenser coil in the winter mode 132 to lower relative humidity of the heated air and increase the air's capacity to absorb water downstream. The supply air heat exchanger 106 generates dry air that is discharged into the conditioned air region 105. When processing air having extreme cold temperatures, the supply air heat exchanger will be operating in a very inefficient matter. Because the outside air is first heated by the pre-processing module 102, the supply air heat exchanger 106 is capable of heating outside air having extreme cold temperatures very efficiently. For example, the pre-processing module 102 is capable of conditioning air having a temperature below 32° F. Using the components illustrated in FIG. 2, the pre-processing module 102 is capable of conditioning air having a temperature between −10° F. and 32° F. With additional components, for example the components illustrated in FIGS. 7-21, the pre-processing module 102 is capable of conditioning air having temperature between −30° F. and 32° F. Moreover, the supply air heat exchanger 106 is capable of conditioning air having a temperature below 50° F., in the winter mode 132.

The lowered relative humidity heated air travels from the supply air heat exchanger 106 through the supply air side 113 of the processing module 104. The processing module adds moisture to the conditioned air to produce humidified supply air. The humidified supply air flows into the processed air region 107. From the processed air region 107, the supply air flows through the supply air outlet 110 and into the space.

The return air flow path 140 of the winter mode 132 differs from the return air flow path 120 of the summer mode. The dampers 125, 127, 129, and 131 may be opened and/or closed to change the return air flow path 120 of the summer mode 130 to return air flow path 140 of the winter mode 132. Additionally, the functions of at least some of the system components may change in the winter mode 132. The return air flow path 140 is defined between the return air inlet 116 and a return air outlet 142.

Return air flows through the return air inlet 116 and into the return air region 117. The return air then flows into the return air side 111 of the pre-processing module 102. The pre-processing module 102 transfers heat and moisture from the return air into the supply air passing through the supply air side 109 of the pre-processing module 102, thereby cooling the air in the return air flow path 140. The cooled air flows into the pre-processed air region 119 and is channeled through dampers 125, 127, 129, and 131. In the winter mode 132 dampers 125 and 129 are closed and dampers 127 and 131 are opened to direct the cooled air to the return air side 115 of the processing module 104.

The processing module 104 is regenerated by the supply air. The processing module 104 removes moisture from the cooled air in the return air side 115 and discharges the moisture into the dry air in the supply air side 113. The processing module 104 dehumidifies air in the return air flow path 140 while humidifying the supply air flow. The dehumidified air is discharged into a processed air region 144. The dehumidified air in the processed air region 144 is channeled to the return air heat exchanger 114.

The return air heat exchanger 114 operates as an evaporator coil in the winter mode 130 to cool the dehumidified air. The heat exchanger 114 also removes heat from the return air and discharges the heat to the supply air heat exchanger 106. The heat exchanger 114 cools the dehumidified air to generate cooled exhaust air. When cooling air having extreme cold temperatures, the return air heat exchanger is susceptible to freezing. Because the return air is first dehumidified by the processing module 104, the dehumidified air in the processed air region 144 is able to be cooled by the return air heat exchanger 114 to very cold temperatures without the risk of freezing. Furthermore, as the return air is dried by the processing module 104, the air's dry bulb condition in the processed air region 144 is raised, thus enabling additional heat transfer to the supply air heat exchanger 106 improving efficiency of the system. The cooled exhaust air flows into a conditioned air region 146 and is channeled through return air outlet 142 and exhausted from the building.

Figure 5:
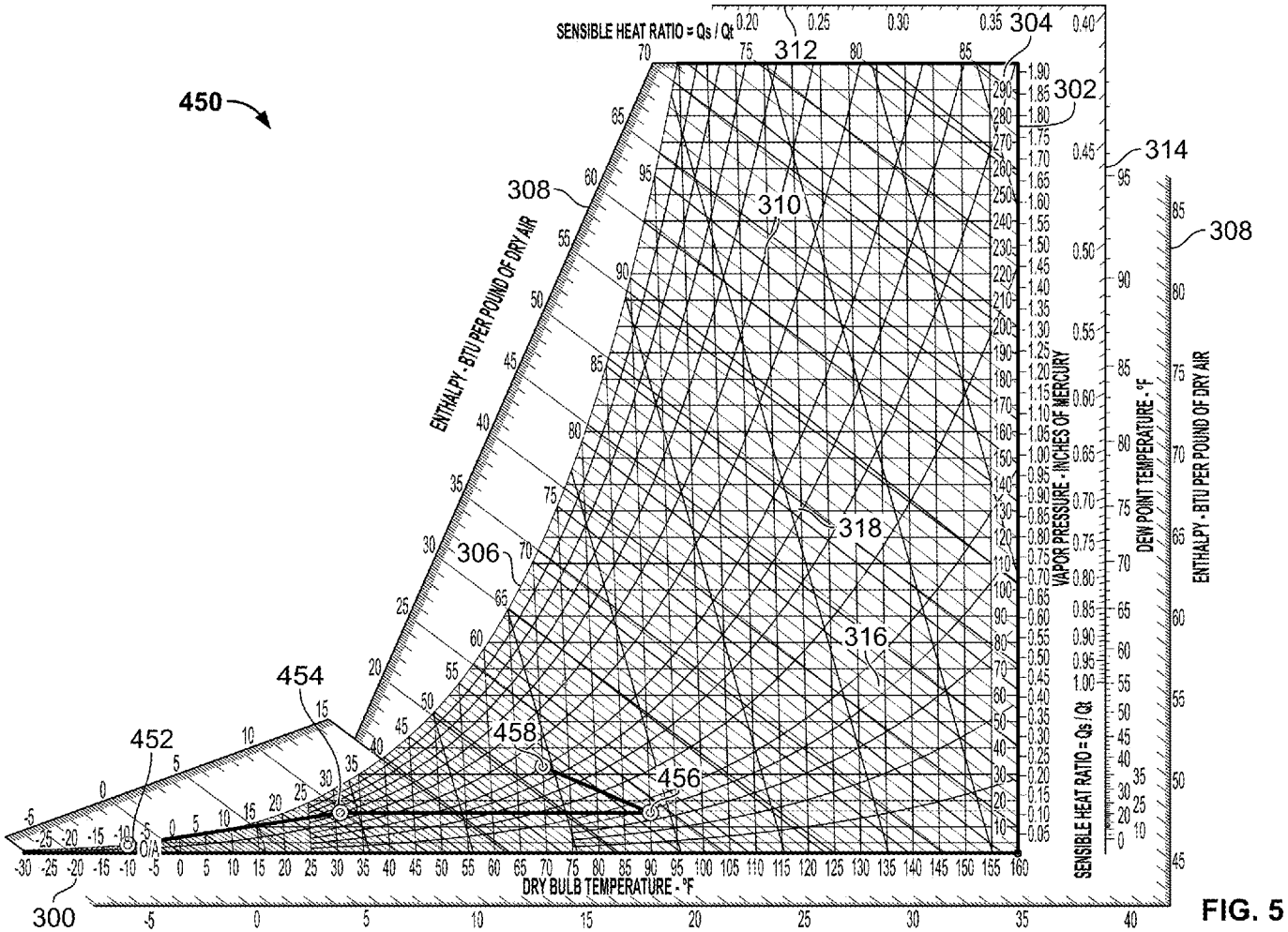
FIG. 5 is a psychrometric chart of the supply air of a heat pump system operating in a winter mode.
Figure 6:
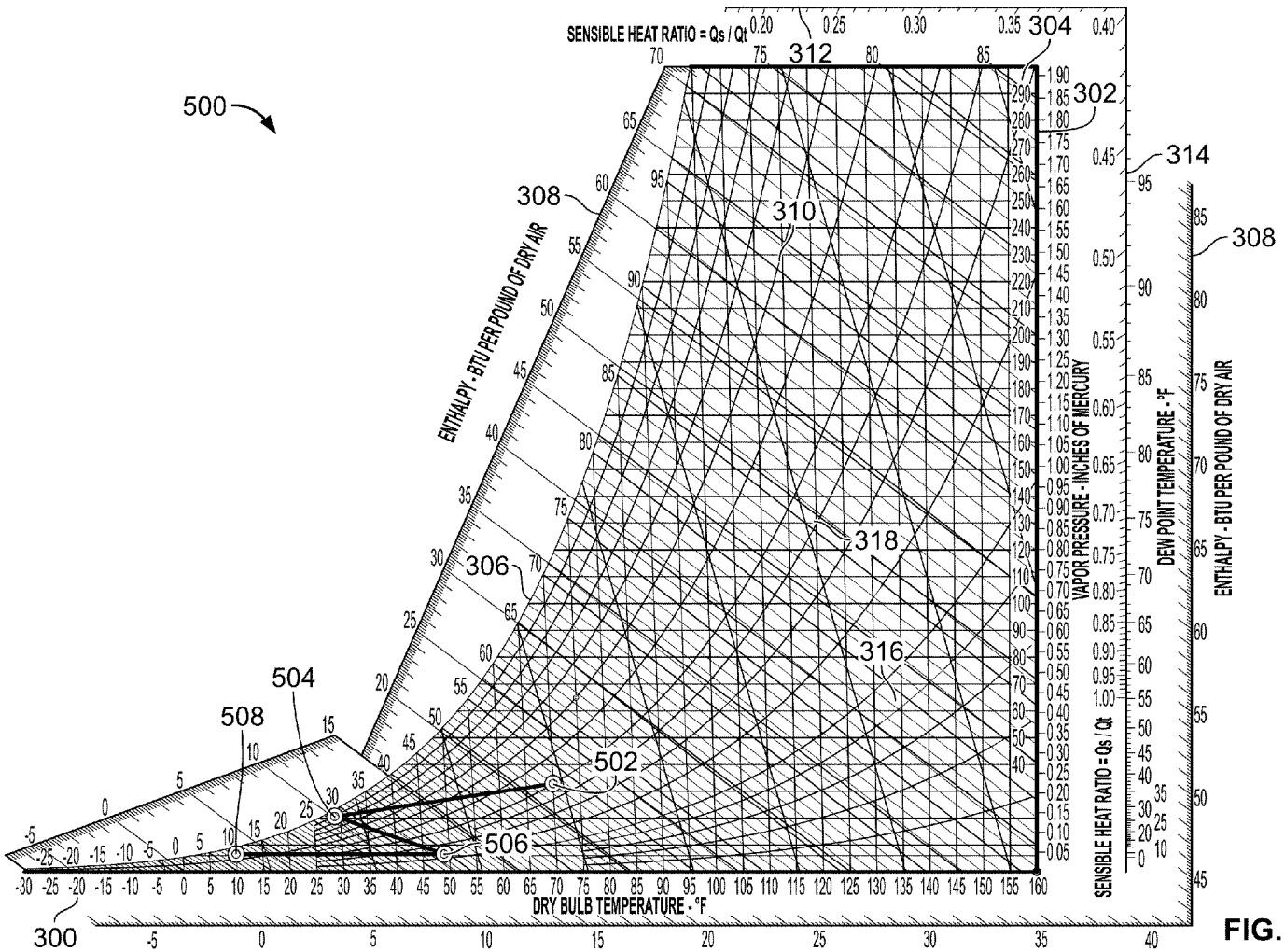
FIG. 6 is a psychrometric chart of the return air of a heat pump system operating in a winter mode.

FIGS. 5 and 6 illustrate psychrometric charts 450 and 500 for the system 100 when operating in the winter mode 132. It should be noted that the charts 450 and 500 are exemplary only and illustrate a single operating point for the winter mode 132 operating conditions. The charts 450 and 500 include an x-axis 300 that illustrates a dry bulb temperature of the air in degrees Fahrenheit and a y-axis 302 that illustrates vapor pressure in inches of mercury. A second y-axis 304 illustrates a humidity ratio in grains of moisture per pound of dry air. Curve 306 illustrates a saturation point of the air and lines 308 illustrate an enthalpy of the air in BTU per pound of dry air. Lines 310 illustrate a wet bulb temperature of the air in degrees Fahrenheit. A sensible heat ratio is illustrated on line 312 and a dew point temperature in degrees Fahrenheit is illustrated on line 314. A relative humidity of the air is illustrated on curves 316 and a volume of the air in cubic feet per pound of dry air is illustrated on curves 318.

FIG. 5 is a psychrometric chart 450 illustrating the condition of the outside air in the supply air flow path 112, when the system 100 is operating in the winter mode 132 and when the outside air enters the system 100 through the supply air inlet 108 and flows into the outside air region 101. Point 452 of chart 450 illustrates the conditions of the outside air. At point 452, the outside air has a dry bulb temperature of approximately −10° F. and a wet bulb temperature of approximately −10° F. The enthalpy of the outside air is approximately −2 BTU per pound of dry air and the humidity ratio is approximately 3 grains of moisture per pound of dry air.

The outside air passes through the supply air side 109 of the pre-processing module 102 where the air is heated and discharged into the pre-processed air region 103. Point 454 of chart 450 illustrates the conditions of the heated air in the pre-processed air region 103. At point 454, the heated air has a dry bulb temperature of approximately 30° F. and a wet bulb temperature of approximately 27° F. The enthalpy of the heated air is approximately 9.5 BTU per pound of dry air and the humidity ratio is approximately 16 grains of moisture per pound of dry air.

The heated air passes through the supply air heat exchanger 106. In the winter mode 132, the supply air heat exchanger 106 operates as a condenser coil to heat the air using heat discharged from the return air heat exchanger 114. The supply air heat exchanger 106 also lowers relative humidity of the air to increase the air's capacity to absorb water downstream. The supply air heat exchanger 106 lowers relative humidity of heated air that is discharged into the conditioned air region 105. Point 456 illustrates the conditions of the heated air. At point 456 the heated air has a dry bulb temperature of approximately 90° F. and a wet bulb temperature of approximately 56.7° F. The enthalpy of the dried air is approximately 24 BTU per pound of dry air and the humidity ratio is approximately 16 grains of moisture per pound of dry air.

The heated air travels downstream through the supply side 113 of the processing module 104 where humidity from the return air in the return side 115 is discharged into the lower relative humidity air in the supply side 113. The humidified supply air is discharged into the processed air region 107. Point 458 of chart 450 illustrates the conditions of the supply air. At point 458, the supply air has a dry bulb temperature of approximately 70° F. and a wet bulb temperature of approximately 53° F. The enthalpy of the supply air is approximately 22 BTU per pound of dry air and the humidity ratio is approximately 33 grains of moisture per pound of dry air. The supply air is discharged through the supply air outlet 110 and into the building.

FIG. 6 is a psychrometric chart 500 illustrating the condition of the air in the return air flow path 140 when the system 100 is operating in the winter mode 132 and when the return air enters the system 100 through the return air inlet 116 and flows into the return air region 117. Point 502 of chart 500 illustrates the conditions of the return air. The return air has a dry bulb temperature of approximately 70° F. and a wet bulb temperature of approximately 53° F. The enthalpy of the return air is approximately 22 BTU per pound of dry air and the humidity ratio is approximately 33 grains of moisture per pound of dry air.

The return air flows through the return air side 111 of the pre-processing module 102 where heat is removed from the return air and discharged into the outside air in the supply air side 109 of the pre-processing module 102. The pre-processing module 102 produces cooled air in the return air flow path 140 that is discharged into the pre-processed air region 119. Point 504 of chart 500 illustrates the conditions of the cooled air in the pre-processed air region 119. The cooled air has a dry bulb temperature of approximately 28° F. and a wet bulb temperature of approximately 27° F. The enthalpy of the cooled air is approximately 10 BTU per pound of dry air and the humidity ratio is approximately 20 grains of moisture per pound of dry air.

The cooled air passes through return air side 115 of the processing module 104. The processing module 104 transfers humidity from the cooled air in the return air side 115 to the dry air in the supply air side 113 of the processing module 104. Dehumidified air is discharged from the processing module 104 into the processed air region 144. Point 506 of chart 500 illustrates the conditions of the dehumidified air in the processed air region 144. The dehumidified air in the processed air region 144 has a dry bulb temperature of approximately 49° F. and a wet bulb temperature of approximately 34° F. The enthalpy of the dehumidified air is approximately 13 BTU per pound of dry air and the humidity ratio is approximately 7 grains of moisture per pound of dry air.

The dehumidified air then passes through the return air heat exchanger 114. In the winter mode 132, the return air heat exchanger 114 operates as an evaporator coil to cool the dehumidified air. The return air heat exchanger 114 removes heat from the dehumidified air. The heat is discharged into the supply air heat exchanger 106 to heat the supply air traveling through the supply air heat exchanger 106. Cooled exhaust air is discharged from the return air heat exchanger 114 into the conditioned air region 146. Point 508 of chart 500 illustrates the conditions of the exhaust air. At point 508, the exhaust air has a dry bulb temperature of approximately 10° F. and a wet bulb temperature of approximately 9° F. The enthalpy of the exhaust air is approximately 3 BTU per pound of dry air and the humidity ratio is approximately 7 grains of moisture per pound of dry air. The exhaust air is discharged from the space through the return air outlet 142.

Figure 7:
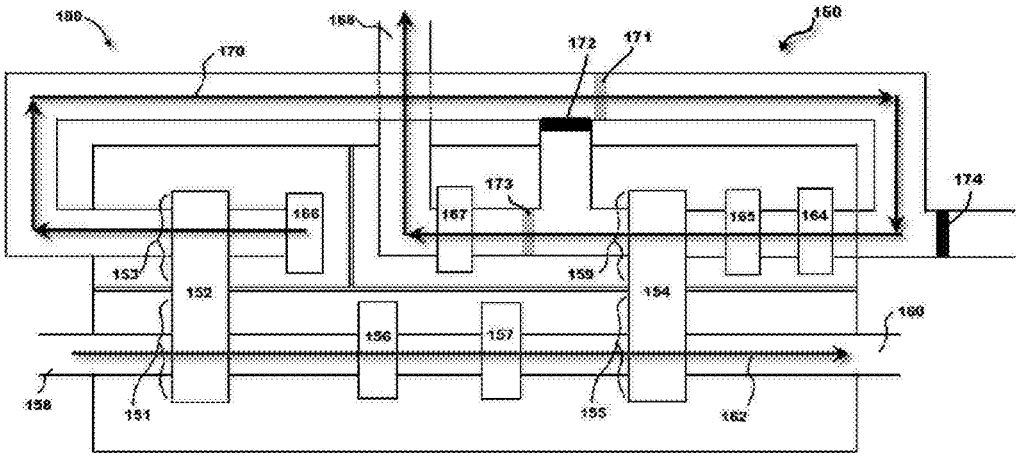
FIG. 7 is a schematic view of another heat pump system formed in accordance with an embodiment and operating in a summer mode.
Figure 8:
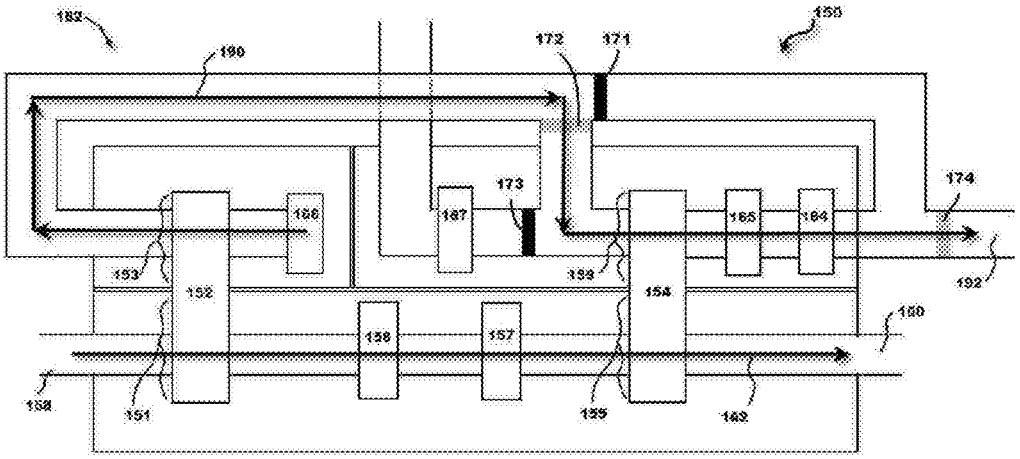
FIG. 8 is a schematic view of the system shown in FIG. 7 operating in a winter mode.

FIG. 7 is a schematic view of another heat pump system 150 operating in a summer mode 180. FIG. 8 is a schematic view of the system 150 operating in a winter mode 182. In the summer mode 180, a supply air flow path 162 and a return air flow path 170 flow through the system 150. In the winter mode 182, the supply air flow path 162 follows the same path as defined in the summer mode 180 and return air follows a return air flow path 190. In the winter mode 182 the function of the system components may differ from the function of the system components in the summer mode 180. The system 150 includes dampers 171, 172, 173, and 174 to redirect the return air path 170 of the summer mode 180 into the return air path 190 of the winter mode 182.

Referring to the summer mode 180 illustrated in FIG. 7, outside air flows through the supply air inlet 158 and downstream to a supply air side 151 of a pre-processing module 152. The pre-processing module 152 removes heat from the outside air. The outside air discharged from the pre-processing module 152 flows into a pair supply air heat exchangers 156 and 157. In the summer mode 180, the supply air heat exchangers 156 and 157 operate as evaporator coils to saturate the outside air. The outside air then flows downstream to a supply air side 155 of a processing module 154. The processing module 154 removes moisture from the outside air to generate dehumidified supply air that is discharged through the supply air outlet 160 and into the space. At least one fan (not shown) may be positioned within the supply air flow path 162 to move the supply air from the supply air inlet 158 downstream to the supply air outlet 160.

In the summer mode 180, return air flows through the return air inlet 166 and through a return air side 153 of the pre-processing module 152. The pre-processing module 152 removes heat from the outside air in the supply air side 151 and transfers the heat to the return air in the return air side 153. The return air is then channeled to a return air heat exchanger 164, which preferably is shut off. The return air travels through the return air heat exchanger 164 unchanged and into a return air heat exchanger 165. In the summer mode 180, the return air heat exchanger 165 operates as a condenser coil to lower relative humidity of the return air to increase the air's capacity to absorb water downstream. The return air heat exchanger 165 uses the heat removed from the supply air by the supply air heat exchanger 157 to dry the return air. The heated return air then flows to a return air side 159 of the processing module 154 and receives moisture from the supply air side 155. The return air discharged from the processing module 154 flows through a return air heat exchanger 167 which operates as a condenser coil to further heat the return air using the heat from the supply air heat exchanger 156. The return air is then discharged through a return air outlet 168. It is understood that heat exchangers in the supply and return air flow paths could be matched differently then that stated previously. For instance, the return air heat exchanger 165 could also be coupled with supply air heat exchanger 156. Likewise the return air heat exchanger 167 could also be coupled with supply air heat exchanger 157. Furthermore, it is understood that supply and return air heat exchangers in FIGS. 7-21 can be coupled differently.

Referring to FIG. 8, the winter mode 182 of the system 150 is illustrated. The supply air flow path 162 follows the same path as defined in the summer mode 180. In the winter mode 182 the function of the system components may differ from the function of the system components in the summer mode 180. Supply air enters the supply air inlet 158 and flows downstream to the pre-processing module 152 where the supply air receives heat from the return air flow path 190. The supply air discharged from the pre-processing module 152 flows into the supply air heat exchangers 156 and 157. In the winter mode 182, the supply air heat exchangers 156 and 157 operate as condenser coils to heat, lower relative humidity of the supply air and increase the air's capacity to absorb water downstream. The dried supply air then travels to the processing module 154 where the supply air receives moisture from the return air flow path 190 to generate humidified supply air. The humidified supply air is discharged through the supply air outlet 160 and into the space.

The return air flow path 190 of the winter mode 182 differs from the return air flow path 170 of the summer mode 180. The dampers 171, 172, 173, and 174 of the system 150 are open and/or closed to change the return air flow path 170 of the summer mode 180 to the return air flow path 190 of the winter mode 182. Additionally, the functions of at least some of the system components may change in the winter mode 182. Return air enters the return air flow path 190 through the return air inlet 166. The return air flows through the pre-processing module 152 where heat is removed from the return air. The heat is discharged into the supply air flow path 162. The return air then flows to the processing module 154 where moisture is removed from the return air. The moisture from the return air is discharged into the supply air flow path 162. The return air discharged from the processing module 154 travels to the return air heat exchangers 165 and 164. In the winter mode 182, the return air heat exchangers 165 and 164 operate as evaporator coils to cool the return air prior to the return air being discharged through the return air outlet 192. It is understood that the return air flow path 190 of the winter mode could alternatively flow through the return air heat exchanger 167 which is preferably shut off and then to the process module 154 depending on the damper (not shown) location and operation.

In one embodiment, the heat pump system 150 senses a condition of at least one of the supply air or return air from the space to control an output of at least one of the pre-processing module 152, the processing module 154, the supply air heat exchangers 156 and/or 157, and/or the return air heat exchangers 164, 165, and/or 167 to achieve a pre-determined dehumidification of the supply air in summer and a pre-determined humidification of the supply air in the winter mode 882.

In another embodiment, the heat pump system 150 senses a condition of at least one of the supply air or return air from the space to control an output of at least one of the pre-processing module 152, the processing module 154, the supply air heat exchangers 156 and/or 157, and/or the return air heat exchangers 164, 165, and/or 167 to achieve a pre-determined performance of the system 150.

In another embodiment, the heat pump system 150 senses a condition of at least one of the supply air or return air from the space to and control an output of at least one of the pre-processing module 152, the processing module 154, the supply air heat exchangers 156 and/or 157, and/or the return air heat exchangers 164, 165, and/or 167 to limit frost formation in at least one of the pre-processing module 152 and/or return air heat exchangers 164, 165, and/or 167 in the winter mode 182.

Figure 9:
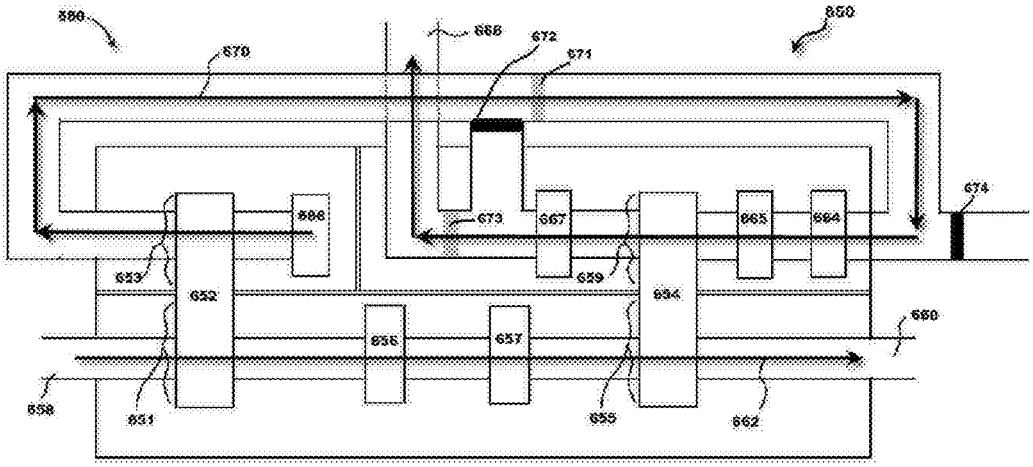
FIG. 9 is a schematic view of another heat pump system formed in accordance with an embodiment and operating in a summer mode.
Figure 10:
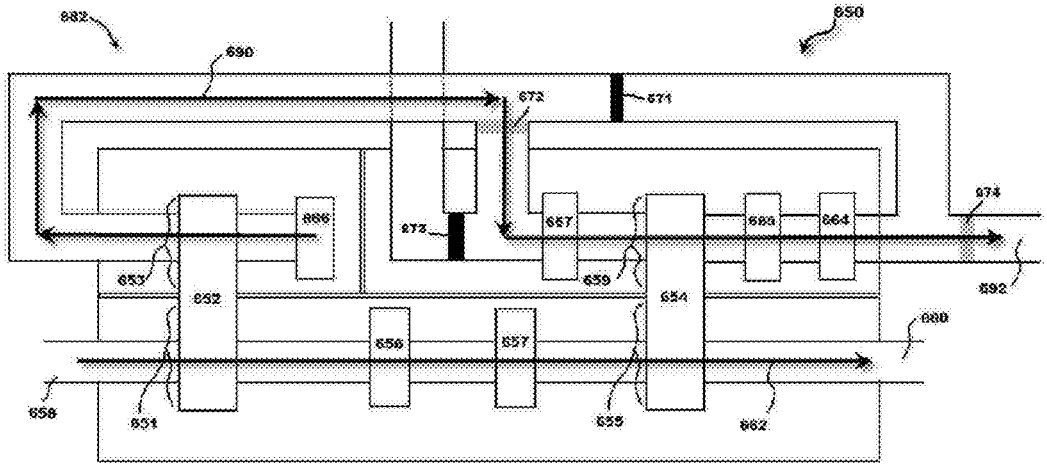
FIG. 10 is a schematic view of the system shown in FIG. 9 operating in a winter mode.

FIG. 9 illustrates another heat pump system 650 formed in accordance with an embodiment and operating in a summer mode 680. FIG. 10 illustrates the heat pump system 650 operating in a winter mode 682. In the summer mode 680, a supply air flow path 662 and a return air flow path 670 flow through the system 650. In the winter mode 682, the supply air flow path 662 follows the same path as defined in the summer mode 680 and return air follows a return air flow path 690. In the winter mode 682 the function of the system components may differ from the function of the system components in the summer mode 680. The system 650 includes dampers 671, 672, 673, and 674 to redirect the return air path 670 of the summer mode 680 into the return air path 690 of the winter mode 682.

Referring to the summer mode 680 illustrated in FIG. 9, outside air flows through the supply air inlet 658 and downstream to a supply air side 651 of a pre-processing module 652. The pre-processing module 652 removes heat from the outside air. The outside air discharged from the pre-processing module 652 flows into a pair supply air heat exchangers 656 and 657. In the summer mode 680, the supply air heat exchangers 656 and 657 operate as evaporator coils to saturate the outside air. The outside air then flows downstream to a supply air side 655 of a processing module 654. The processing module 654 removes moisture from the outside air to generate dehumidified supply air that is discharged through the supply air outlet 660 and into the space. At least one fan (not shown) may be positioned within the supply air flow path 662 to move the supply air from the supply air inlet 658 downstream to the supply air outlet 660.

In the summer mode 680, return air flows through the return air inlet 666 and through a return air side 653 of the pre-processing module 652. The pre-processing module 652 removes heat from the outside air in the supply air side 651 and transfers the heat to the return air in the return air side 653. The return air is then channeled to a return air heat exchanger 664 and a return air heat exchanger 665. In the summer mode 680, the return air heat exchangers 664 and 665 operate as condenser coils to lower relative humidity of the return air to increase the air's capacity to absorb water downstream. The return air heat exchangers 664 and 665 use the heat removed from the supply air by the supply air heat exchanger 657 to dry the return air. The heated return air then flows to a return air side 659 of the processing module 654 and receives moisture from the supply air side 655. The return air discharged from the processing module 654 flows through a return air heat exchanger 667 which operates as a condenser coil to further heat the return air using the heat from the supply air heat exchanger 656. The return air is then discharged through a return air outlet 668.

Referring to FIG. 10, the winter mode 682 of the system 650 is illustrated. The supply air flow path 662 follows the same path as defined in the summer mode 680. In the winter mode 682 the function of the system components may differ from the function of the system components in the summer mode 680. Supply air enters the supply air inlet 658 and flows downstream to the pre-processing module 652 where the supply air receives heat from the return air flow path 690. The supply air discharged from the pre-processing module 652 flows into the supply air heat exchangers 656 and 657. In the winter mode 682, the supply air heat exchangers 656 and 657 operate as condenser coils to heat, lower relative humidity of the supply air and increase the air's capacity to absorb water downstream. The dried supply air then travels to the processing module 654 where the supply air receives moisture from the return air flow path 690 to generate humidified supply air. The humidified supply air is discharged through the supply air outlet 660 and into the space.

The return air flow path 690 of the winter mode 682 differs from the return air flow path 670 of the summer mode 680. The dampers 671, 672, 673, and 674 of the system 650 are open and/or closed to change the return air flow path 670 of the summer mode 680 to the return air flow path 690 of the winter mode 682. Additionally, the functions of at least some of the system components may change in the winter mode 682. Return air enters the return air flow path 690 through the return air inlet 666. The return air flows through the pre-processing module 652 where heat is removed from the return air. The heat is discharged into the supply air flow path 662. The return air then flows to the return air heat exchanger 667 which operates as an evaporator coil to cool the return air prior to entering the processing module 654 where moisture is removed from the return air. The moisture from the return air is discharged into the supply air flow path 662. The return air discharged from the processing module 654 travels to the return air heat exchangers 665 and 664. In the winter mode 682, the return air heat exchangers 665 and 664 operate as evaporator coils to cool the return air prior to the return air being discharged through the return air outlet 692.

Figure 11:
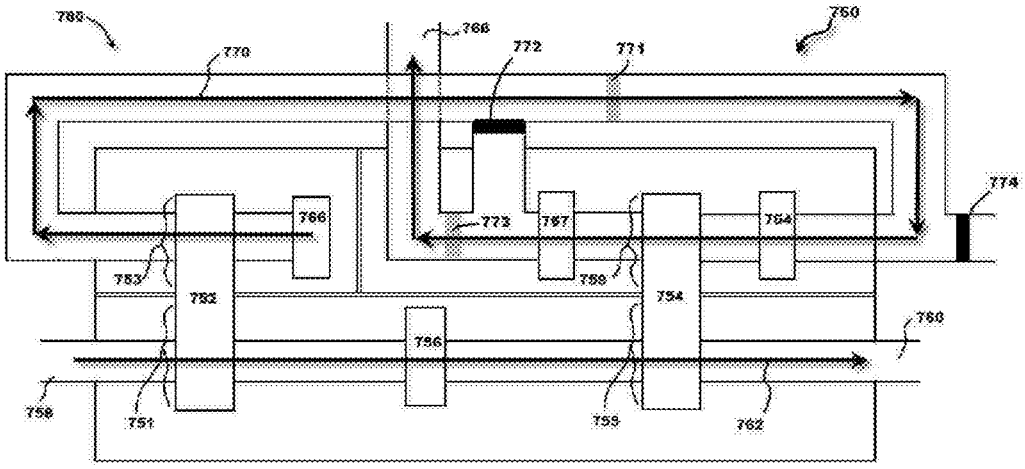
FIG. 11 is a schematic view of another heat pump system formed in accordance with an embodiment and operating in a summer mode.
Figure 12:
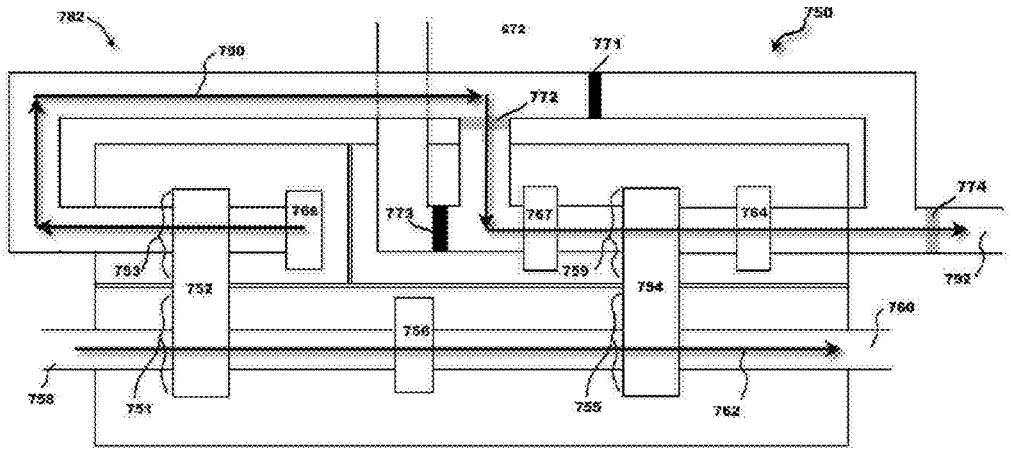
FIG. 12 is a schematic view of the system shown in FIG. 11 operating in a winter mode.

FIG. 11 illustrates another heat pump system 750 formed in accordance with an embodiment and operating in a summer mode 780. FIG. 12 illustrates the heat pump system 750 operating in a winter mode 782. In the summer mode 780, a supply air flow path 762 and a return air flow path 770 flow through the system 750. In the winter mode 782, the supply air flow path 762 follows the same path as defined in the summer mode 780 and return air follows a return air flow path 790. In the winter mode 782 the function of the system components may differ from the function of the system components in the summer mode 780. The system 750 includes dampers 771, 772, 773, and 774 to redirect the return air path 770 of the summer mode 780 into the return air path 790 of the winter mode 782.

Referring to the summer mode 680 illustrated in FIG. 11, outside air flows through the supply air inlet 758 and downstream to a supply air side 751 of a pre-processing module 752. The pre-processing module 752 removes heat from the outside air. The outside air discharged from the pre-processing module 752 flows into a supply air heat exchanger 756. In the summer mode 780, the supply air heat exchanger 756 operates as an evaporator coil to saturate the outside air. The outside air then flows downstream to a supply air side 755 of a processing module 754. The processing module 754 removes moisture from the outside air to generate dehumidified supply air that is discharged through the supply air outlet 760 and into the space. At least one fan (not shown) may be positioned within the supply air flow path 762 to move the supply air from the supply air inlet 758 downstream to the supply air outlet 760.

In the summer mode 780, return air flows through the return air inlet 766 and through a return air side 753 of the pre-processing module 752. The pre-processing module 752 removes heat from the outside air in the supply air side 751 and transfers the heat to the return air in the return air side 753. The return air is then channeled to a return air heat exchanger 764. In the summer mode 780, the return air heat exchanger 764 operates as a condenser coil to lower relative humidity of the return air to increase the air's capacity to absorb water downstream. The return air heat exchanger 764 uses the heat removed from the supply air by the supply air heat exchanger 756 to dry the return air. The heated return air then flows to a return air side 759 of the processing module 754 and receives moisture from the supply air side 755. The return air discharged from the processing module 754 flows through a return air heat exchanger 767 which operates as a condenser coil to further heat the return air using the heat from the supply air heat exchanger 756. The return air is then discharged through a return air outlet 768.

Referring to FIG. 12, the winter mode 782 of the system 750 is illustrated. The supply air flow path 762 follows the same path as defined in the summer mode 780. In the winter mode 782 the function of the system components may differ from the function of the system components in the summer mode 780. Supply air enters the supply air inlet 758 and flows downstream to the pre-processing module 752 where the supply air receives heat from the return air flow path 790. The supply air discharged from the pre-processing module 752 flows into the supply air heat exchanger 756. In the winter mode 782, the supply air heat exchanger 756 operates as a condenser coil to heat, lower relative humidity of the supply air and increase the air's capacity to absorb water downstream. The dried supply air then travels to the processing module 754 where the supply air receives moisture from the return air flow path 790 to generate humidified supply air. The humidified supply air is discharged through the supply air outlet 760 and into the space.

The return air flow path 790 of the winter mode 782 differs from the return air flow path 770 of the summer mode 780. The dampers 771, 772, 773, and 774 of the system 750 are open and/or closed to change the return air flow path 770 of the summer mode 780 to the return air flow path 790 of the winter mode 782. Additionally, the functions of at least some of the system components may change in the winter mode 782. Return air enters the return air flow path 790 through the return air inlet 766. The return air flows through the pre-processing module 752 where heat is removed from the return air. The heat is discharged into the supply air flow path 762. The return air then flows to the return air heat exchanger 767 which operates as an evaporator coil to cool the return air prior to entering the processing module 754 where moisture is removed from the return air. The moisture from the return air is discharged into the supply air flow path 762. The return air discharged from the processing module 754 travels to the return air heat exchanger 764. In the winter mode 782, the return air heat exchanger 764 operates as an evaporator coil to cool the return air prior to the return air being discharged through the return air outlet 792.

Figure 13:
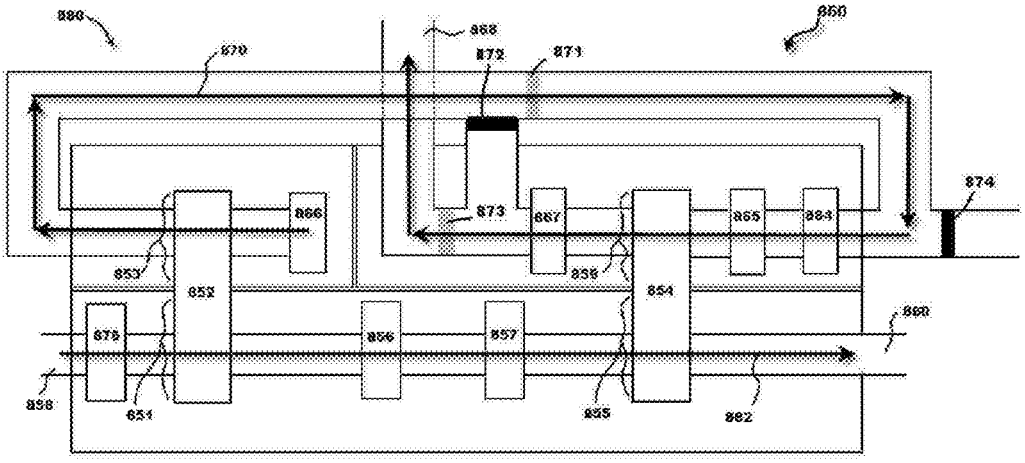
FIG. 13 is a schematic view of another heat pump system formed in accordance with an embodiment and operating in a summer mode.
Figure 14:
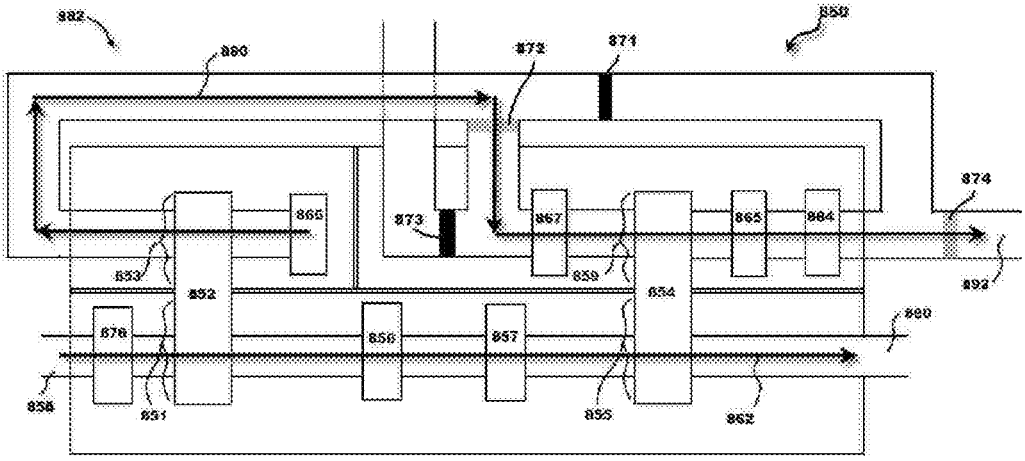
FIG. 14 is a schematic view of the system shown in FIG. 13 operating in a winter mode.

FIG. 13 illustrates another heat pump system 850 formed in accordance with an embodiment and operating in a summer mode 880. FIG. 14 illustrates the heat pump system 850 operating in a winter mode 882. In the summer mode 880, a supply air flow path 862 and a return air flow path 870 flow through the system 850. In the winter mode 882, the supply air flow path 862 follows the same path as defined in the summer mode 880 and return air follows a return air flow path 890. In the winter mode 882 the function of the system components may differ from the function of the system components in the summer mode 880. The system 850 includes dampers 871, 872, 873, and 874 to redirect the return air path 870 of the summer mode 880 into the return air path 890 of the winter mode 882.

Referring to the summer mode 880 illustrated in FIG. 13, outside air flows through the supply air inlet 858 and downstream to a pre-processing supply air heat exchanger 876. In the summer mode 880, the pre-processing supply air heat exchanger 876 is preferably shut off. The supply air flows downstream to a supply air side 851 of a pre-processing module 852. The pre-processing module 852 removes heat from the outside air. The outside air discharged from the pre-processing module 852 flows into supply air heat exchangers 856 and 857. In the summer mode 880, the supply air heat exchangers 856 and 857 operate as evaporator coils to cool the outside air. The outside air then flows downstream to a supply air side 855 of a processing module 854. The processing module 854 removes moisture from the outside air to generate dehumidified supply air that is discharged through the supply air outlet 860 and into the space. At least one fan (not shown) may be positioned within the supply air flow path 862 to move the supply air from the supply air inlet 858 downstream to the supply air outlet 860.

In the summer mode 880, return air flows through the return air inlet 866 and through a return air side 853 of the pre-processing module 852. The pre-processing module 852 removes heat from the outside air in the supply air side 851 and transfers the heat to the return air in the return air side 853. The return air is then channeled to return air heat exchangers 864 and 865. In the summer mode 880, the return air heat exchangers 864 and 865 operate as condenser coils to lower relative humidity of the return air to increase the air's capacity to absorb water downstream. The return air heat exchangers 864 and 865 use the heat removed from the supply air by the supply air heat exchangers 856 and 857 to dry the return air. The heated return air then flows to a return air side 859 of the processing module 854 and receives moisture from the supply air side 855. The return air discharged from the processing module 854 flows through a return air heat exchanger 867 which operates as a condenser coil to further heat the return air using the heat from the supply air heat exchangers 856 and 857. The return air is then discharged through a return air outlet 868.

Referring to FIG. 14, the winter mode 882 of the system 850 is illustrated. The supply air flow path 862 follows the same path as defined in the summer mode 880. In the winter mode 882 the function of the system components may differ from the function of the system components in the summer mode 880. Supply air enters the supply air inlet 858 and flows downstream to pre-processing supply air heat exchanger 876 to heat, lower relative humidity of the outside air and increase the air's capacity to absorb water downstream. The supply air channel downstream to the pre-processing module 852 where the supply air receives heat from the return air flow path 890. The supply air discharged from the pre-processing module 852 flows into the supply air heat exchangers 856 and 857. In the winter mode 882, the supply air heat exchangers 856 and 857 operate as condenser coils to heat, lower relative humidity of the supply air and increase the air's capacity to absorb water downstream. The dried supply air then travels to the processing module 854 where the supply air receives moisture from the return air flow path 890 to generate humidified supply air. The humidified supply air is discharged through the supply air outlet 860 and into the space.

The return air flow path 890 of the winter mode 882 differs from the return air flow path 870 of the summer mode 880. The dampers 871, 872, 873, and 874 of the system 850 are open and/or closed to change the return air flow path 870 of the summer mode 880 to the return air flow path 890 of the winter mode 882. Additionally, the functions of at least some of the system components may change in the winter mode 882. Return air enters the return air flow path 890 through the return air inlet 866. The return air flows through the pre-processing module 852 where heat is removed from the return air. The heat is discharged into the supply air flow path 862. The return air then flows to the return air heat exchanger 867 which operates as an evaporator coil to cool the return air prior to entering the processing module 854 where moisture is removed from the return air. The moisture from the return air is discharged into the supply air flow path 862. The return air discharged from the processing module 854 travels to the return air heat exchangers 864 and 865. In the winter mode 882, the return air heat exchangers 864 and 865 operate as evaporator coils to cool the return air prior to the return air being discharged through the return air outlet 892.

In one embodiment, the heat pump system 850 senses a condition of at least one of the supply air or return air from the space to control an output of at least one of the pre-processing supply air heat exchanger 876, the pre-processing module 852, the processing module 854, the supply air heat exchangers 856 and/or 857, and/or the return air heat exchangers 864, 865, and/or 867 to achieve a pre-determined dehumidification of the supply air in summer and a pre-determined humidification of the supply air in the winter mode 882.

In another embodiment, the heat pump system 850 senses a condition of at least one of the supply air or return air from the space to control an output of at least one of the pre-processing supply air heat exchanger 876, the pre-processing module 852, the processing module 854, the supply air heat exchangers 856 and/or 857, and/or the return air heat exchangers 864, 865, and/or 867 to achieve a pre-determined performance of the system 850.

In another embodiment, the heat pump system 850 senses a condition of at least one of the supply air or return air from the space to and control an output of at least one of the pre-processing supply air heat exchanger 876, the pre-processing module 852, the processing module 854, the supply air heat exchangers 856 and/or 857, and/or the return air heat exchangers 864, 865, and/or 867 to limit frost formation in at least one of the pre-processing module 852 and/or return air heat exchangers 864, 865, and/or 867 in the winter mode 882.

Figure 15:
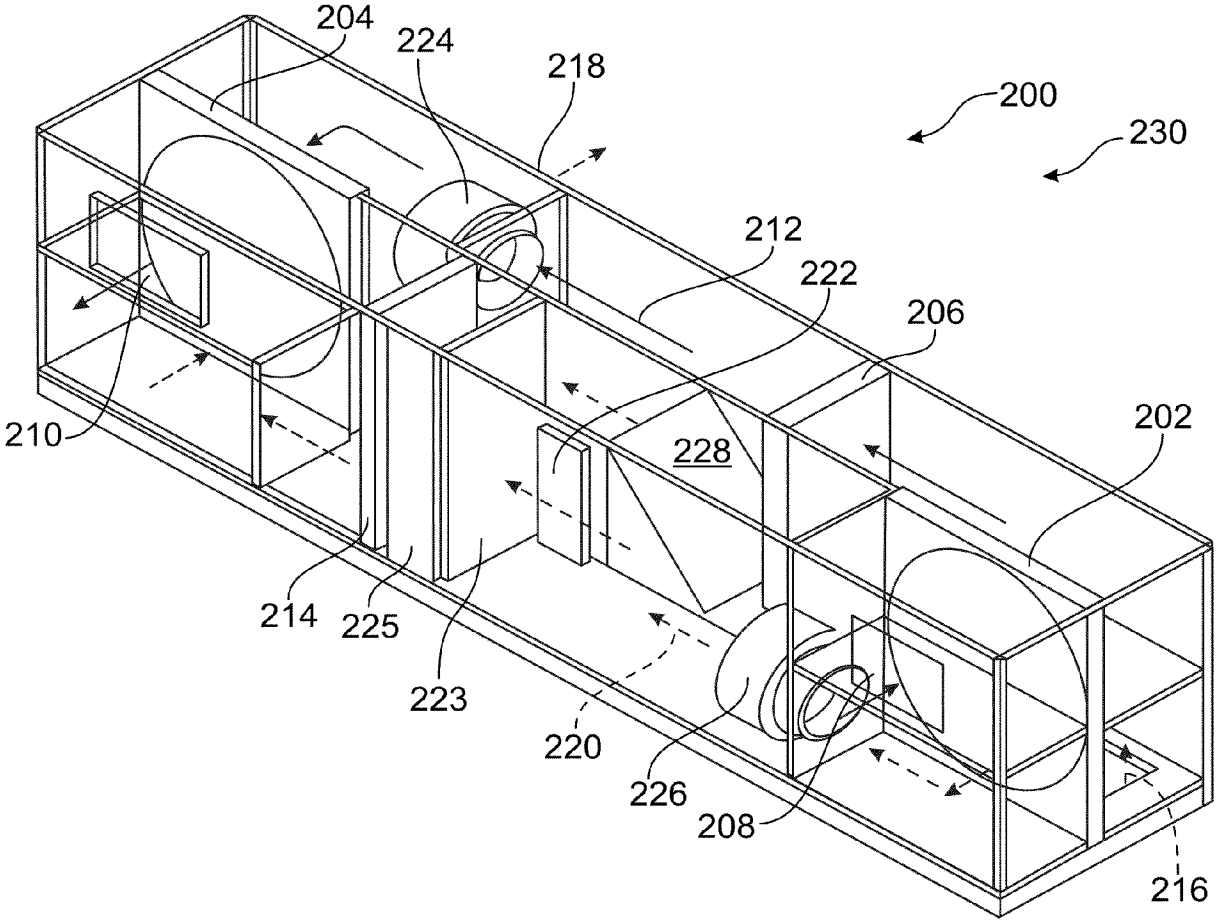
FIG. 15 is a perspective view of another heat pump system formed in accordance with an embodiment and operating in a summer mode.
Figure 16:
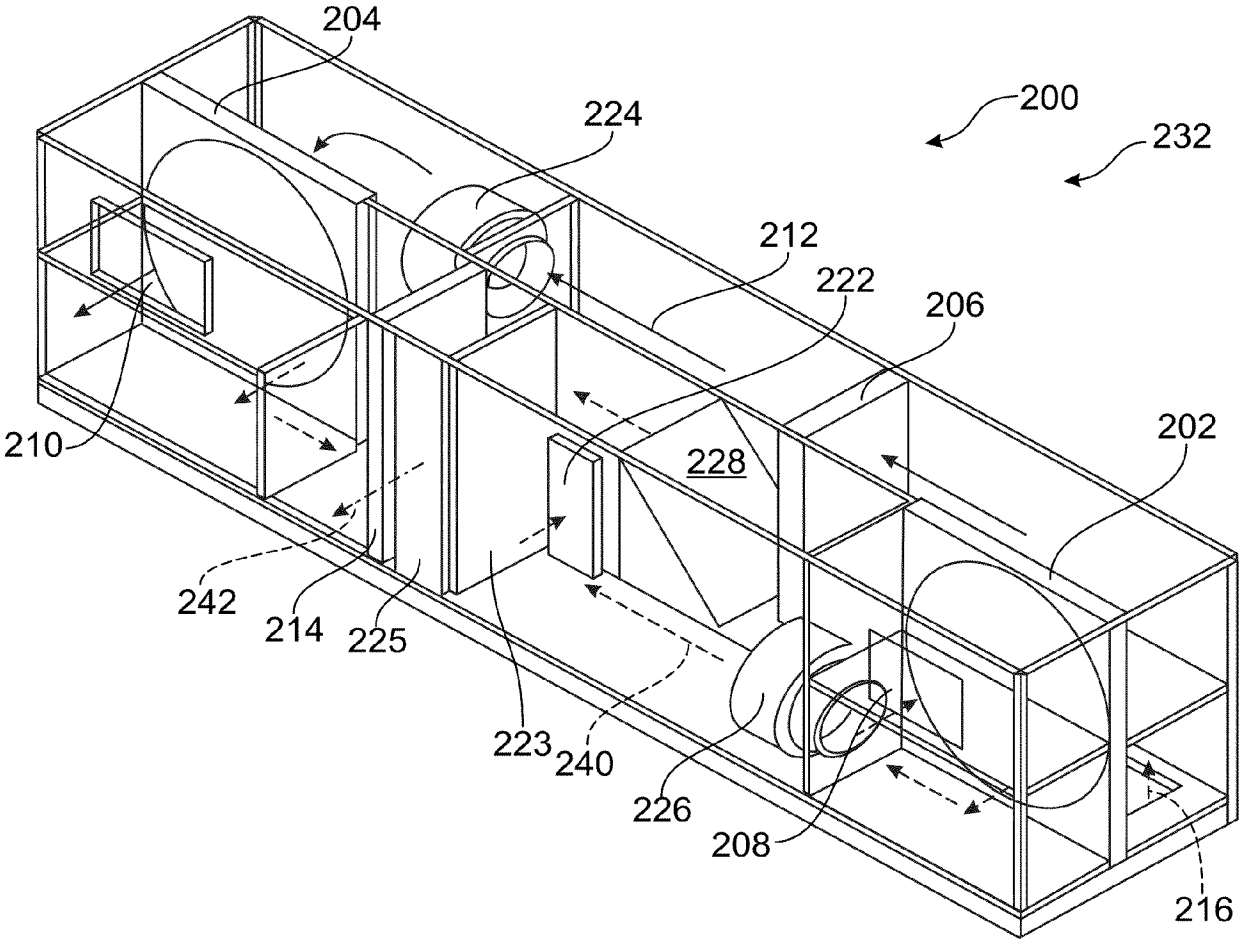
FIG. 16 is a perspective view of the system shown in FIG. 15 operating in a winter mode.

FIG. 15 is a perspective view of another heat pump system 200 operating in a summer mode 230. FIG. 16 is a perspective view of the system 200 operating in a winter mode 232. The system 200 includes a pre-processing module 202 and a processing module 204 in flow communication. A supply air flow path 212 and a return air flow path 220 flow through the pre-processing module 202 and the processing module 204.

The supply air flow path 212 is defined between a supply air inlet 208 and a supply air outlet 210. A fan 224 is positioned within the supply air flow path 212 to move the supply air from the supply air inlet 208 to the supply air outlet 210. A supply air heat exchanger 206 is positioned within the supply air flow path 212 downstream of the supply air inlet 208 and upstream of the supply air outlet 210. The supply air heat exchanger 206 operates as an evaporator coil in the summer mode 230 and a condenser coil in the winter mode 232.

The return air flow path 220 is defined between a return air inlet 216 and a return air outlet 218. A fan 226 is positioned within the return air flow path 220 to move the return air from the return air inlet 216 to the return air outlet 218. A return air heat exchanger 214 is positioned within the return air flow path 220 downstream of the return air inlet 216 and upstream of the return air outlet 218. The return air heat exchanger 214 operates as a condenser coil in the summer mode 230 and an evaporator coil in the winter mode 232.

The system 200 includes dampers 222, 223, and 225 to redirect the return air path 220 between the summer mode 230 and the winter mode 232. The return air path 220 for the summer mode 230 flows between the return air inlet 216 and the return air outlet 218, as illustrated in FIG. 15. The return air path 240 for the winter mode 232 flows between the return air inlet 216 and the return air outlet 242, as illustrated in FIG. 16.

Referring to FIG. 15, the summer mode 230 of the system 200 is illustrated. The supply air flow path 212 begins at the supply air inlet 208 and flows into the pre-processing module 202 where heat in the supply air is removed and discharged into the return air flow path 220. The supply air discharged from the pre-processing module 202 flows into the supply air heat exchanger 206. In the summer mode 230, the supply air heat exchanger 206 operates as an evaporator coil to saturate the supply air. The saturated supply air then flows through the fan 224 and is directed to the processing module 204 where moisture in the supply air is absorbed to generate dehumidified supply air. The supply air is discharged through the supply air outlet 210 and into the space.

Return air is channeled into the return air flow path 220 through the return air inlet 216. The return air flows through the pre-processing module 202 where it receives heat from the supply air. The return air is then channeled through the fan 226 and toward the dampers 222, 223, and 225. The dampers 222 and 225 are closed in the summer mode 230. The damper 223 and the damper near the return air outlet 218 (not shown) is open in the summer mode 230 to channel the return air to the return air heat exchanger 214. In the summer mode 230, the return air heat exchanger 214 operates as a condenser coil to heat, lower relative humidity of the return air and increase the air's capacity to absorb moisture downstream. The dried return air then flows to the processing module 204 where the return air receives moisture from the supply air. The return air is humidified and discharged through the return air outlet 218.

Referring to FIG. 16, the winter mode 232 of the system 200 is illustrated. The supply air flow path 212 follows the same path as defined in the summer mode 230. In the winter mode 232 the function of the system components may differ from the function of the system components in the summer mode 230. The supply air flow path 212 begins at the supply air inlet 208 and flows into the pre-processing module 202 where the supply air receives heat from the return air flow path 240. The heated supply air discharged from the pre-processing module 202 flows though the supply air heat exchanger 206. In the winter mode 232, the supply air heat exchanger 206 operates as a condenser coil to heat, lower relative humidity of the supply air and increase the air's capacity to absorb water downstream. The dried supply air then travels through the fan 224 and to the processing module 204. The processing module 204 humidifies the supply air using moisture from the return air path 240. The humidified air is discharged through the supply air outlet 210 and into the space.

The return air flow path 240 of the winter mode 232 differs from the return air flow path 220 of the summer mode 230. The dampers 222, 223, and 225 are opened and/or closed to change the return air flow path 220 of the summer mode 230 to the return air flow path 240 of the winter mode 232. Return air is channeled into the return air flow path 240 through the return air inlet 216. The return air flows through the pre-processing module 202 where heat is removed from the return air and discharged into the supply air flow path 212. The return air then flows through the fan 226 to the dampers 222, 223, and 225. In the winter mode 232, damper 223 and the damper near the return air outlet 218 (not shown) are closed and damper 222 is opened to channel the return air to a duct 228. The duct 228 directs the return air to the processing module 204 where moisture is absorbed from the return air. The dehumidified return air is discharged from the processing module 204 and channeled to the return air heat exchanger 214. In the winter mode 232, the return air heat exchanger 214 operates as an evaporator coil to cool the return air. Damper 225 is opened in the winter mode 232 so that the return air discharged from the return air heat exchanger 214 flows through damper 225 and is discharged through the return air outlet 242.

Figure 17:
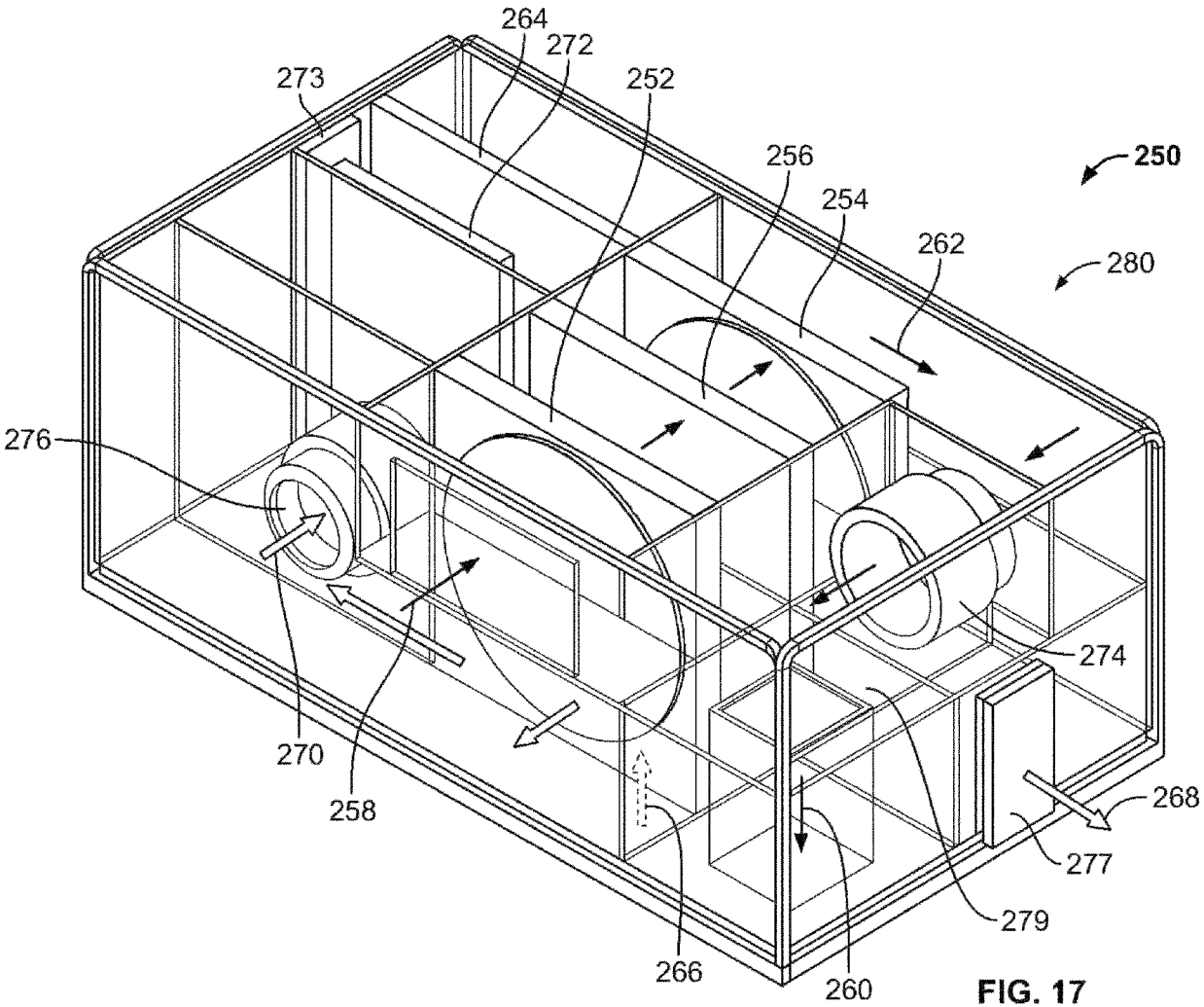
FIG. 17 is a front perspective view of another heat pump system formed in accordance with an embodiment and operating in a summer mode.
Figure 18:
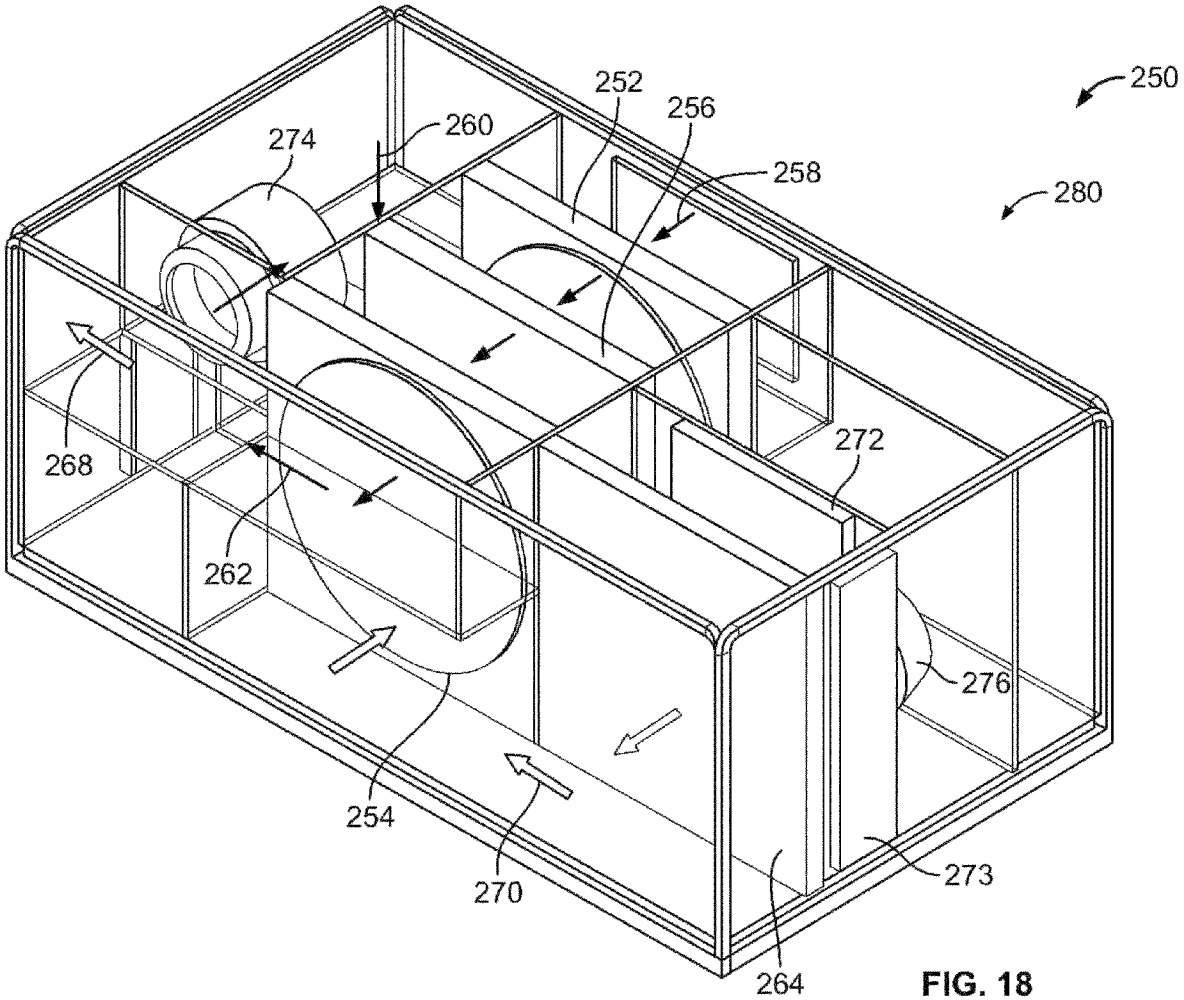
FIG. 18 is a rear perspective view of the system shown in FIG. 17 operating in the summer mode.
Figure 19:
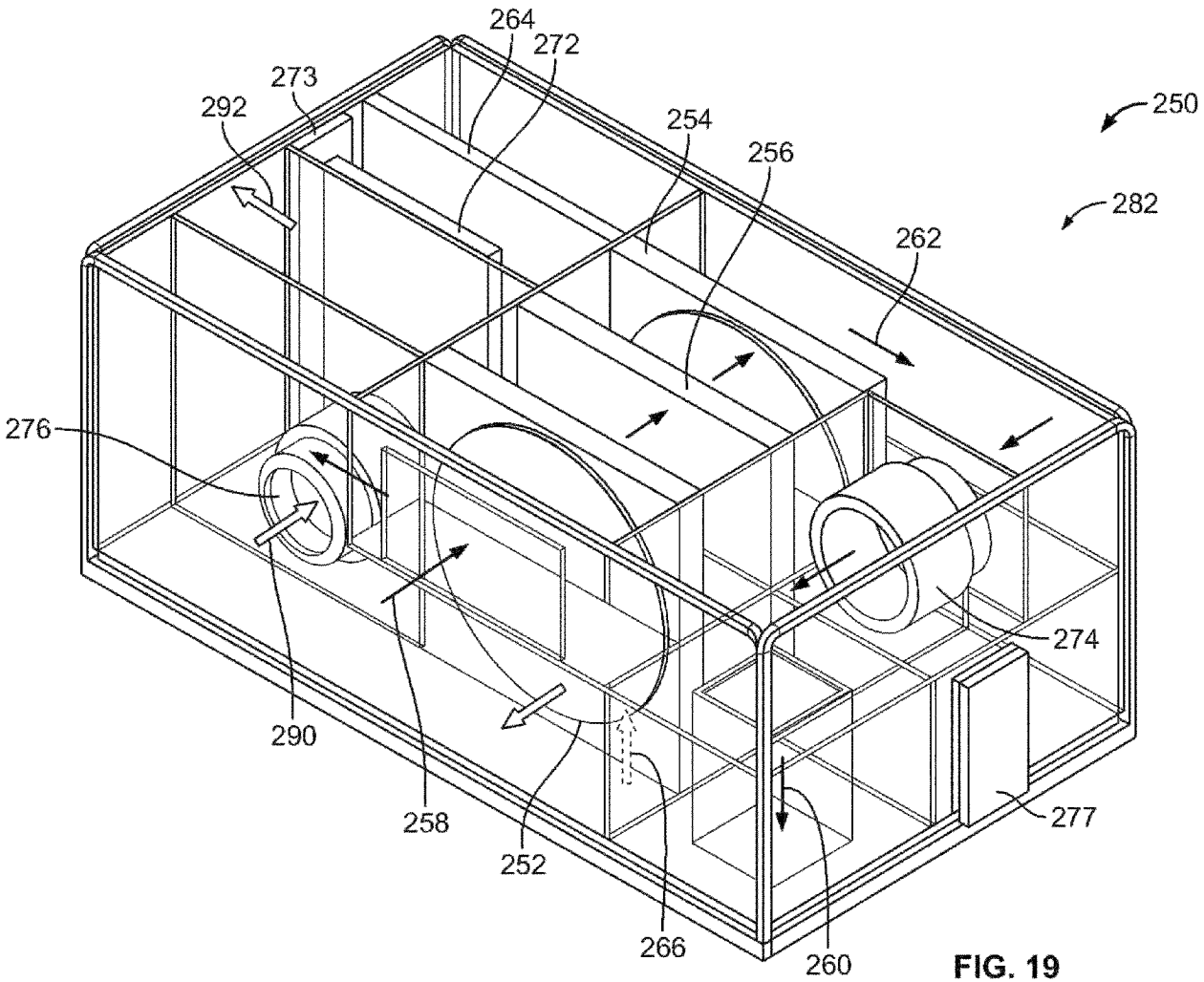
FIG. 19 is a first side front perspective view of the system shown in FIG. 17 operating in a winter mode.
Figure 20:
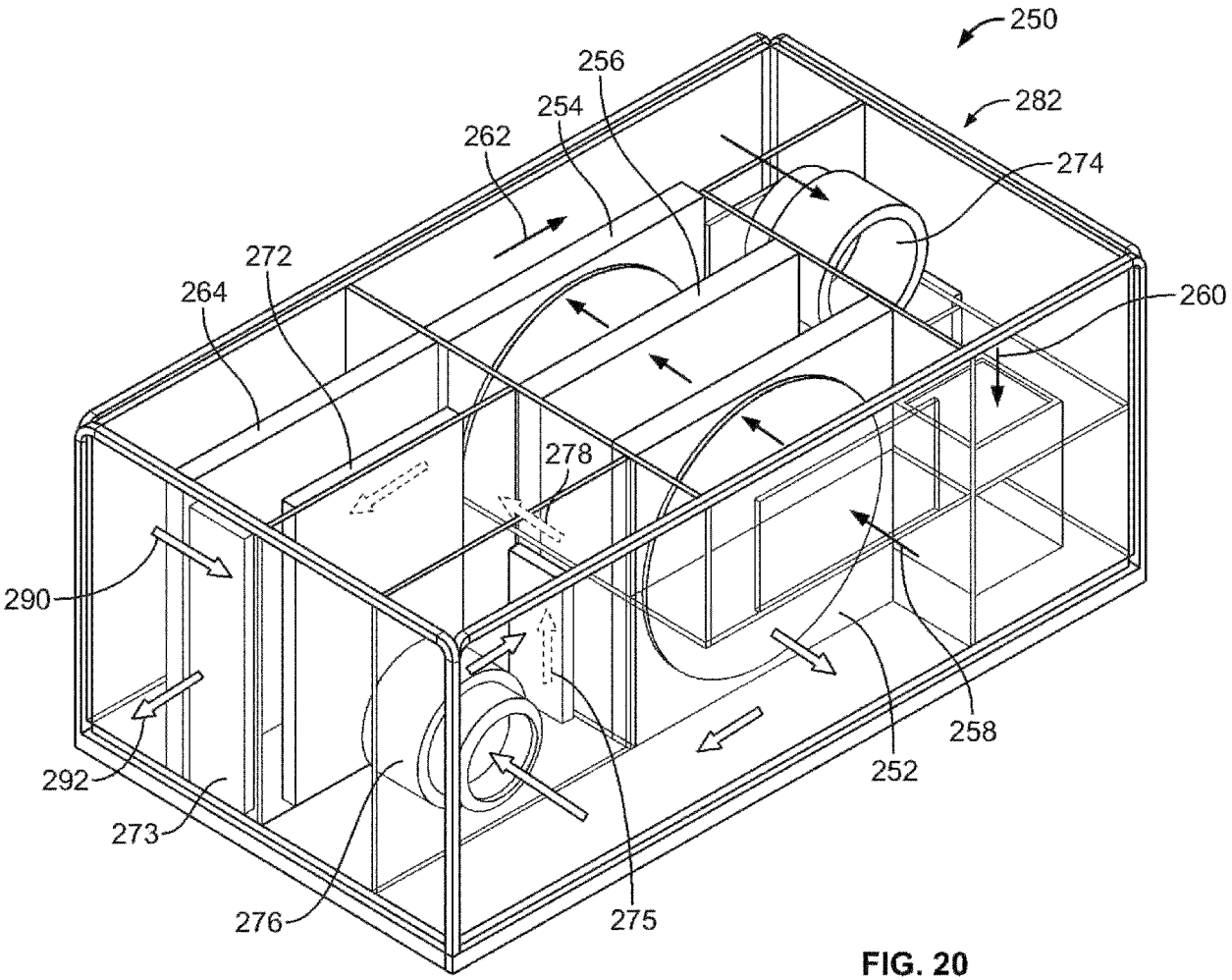
FIG. 20 is a second side front perspective view of the system shown in FIG. 17 operating in the winter mode.
Figure 21:
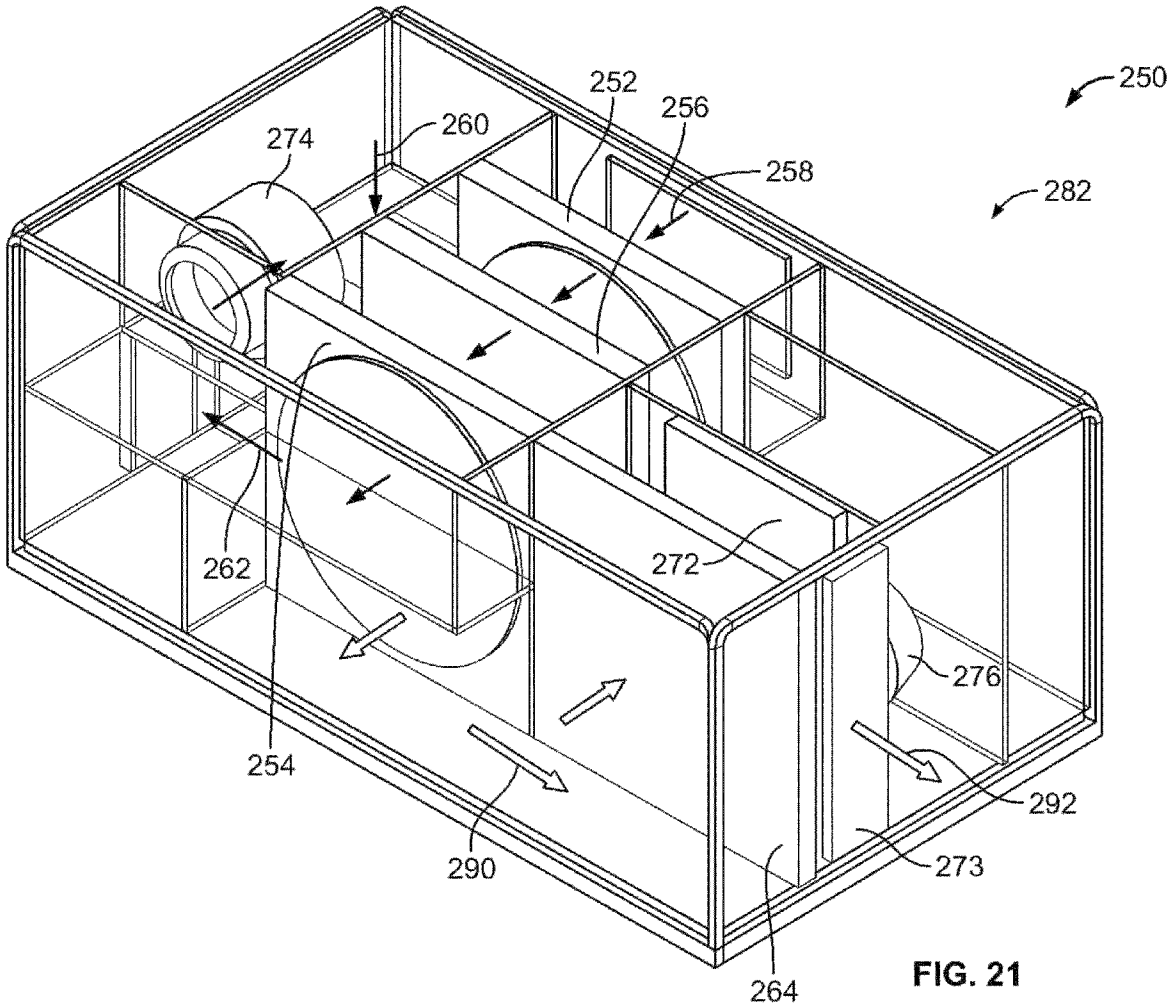
FIG. 21 is a rear perspective view of the system shown in FIG. 17 operating in the winter mode.

FIGS. 17 and 18 are perspective views of another heat pump system 250 operating in a summer mode 280. FIGS. 19-21 are perspective views of the system 250 operating in a winter mode 282. The system 250 includes a pre-processing module 252 and a processing module 254 in flow communication. A supply air flow path 262 and return air flow paths 270 and 290 flow through the pre-processing module 252 and the processing module 254.

The supply air flow path 262 is defined between a supply air inlet 258 and a supply air outlet 260. A fan 274 is positioned within the supply air flow path 262 to move the supply air from the supply air inlet 258 to the supply air outlet 260. A supply air heat exchanger 256 is positioned within the supply air flow path 262 downstream of the supply air inlet 258 and upstream of the supply air outlet 260. The supply air heat exchanger 256 operates as an evaporator coil in the summer mode 280 and a condenser coil in the winter mode 282.

The return air flow path 270 is defined between a return air inlet 266 and a return air outlet 268. A fan 276 is positioned within the return air flow path 270 to move the return air from the return air inlet 266 to the return air outlet 268. A return air heat exchanger 264 is positioned within the return air flow path 270 downstream of the return air inlet 266 and upstream of the return air outlet 268. The return air heat exchanger 264 operates as a condenser coil in the summer mode 280 and an evaporator coil in the winter mode 282.

The system 250 includes dampers 272, 273, 275, and 277 to redirect the return air path 270 between the summer mode 280 and the winter mode 282. The return air path 270 for the summer mode 280 flows between the return air inlet 266 and the return air outlet 268, as illustrated in FIGS. 17 and 18. The return air path 290 for the winter mode 282 flows between the return air inlet 266 and the return air outlet 292, as illustrated in FIGS. 19-21.

Referring to FIGS. 17 and 18, the summer mode 280 of the system 250 is illustrated. The supply air flow path 262 begins at the supply air inlet 258 and flows into pre-processing module 252 where heat in the supply air is removed and discharged into the return air flow path 270. The supply air discharged from the pre-processing module 252 flows into the supply air heat exchanger 256. In the summer mode 280, the supply air heat exchanger 256 operates as an evaporator coil to cool the supply air. The supply air then flows through the processing module 254 where moisture in the supply air is absorbed to dehumidify the supply air. The fan 274 directs the supply air from the processing module 254 to the supply air outlet 260 and into the space.

Return air is channeled into the return air flow path 270 through the return air inlet 266. The return air inlet 266 is positioned between the pre-processing module 252 and a wall extending downward from the supply air heat exchanger 256. The return air flows through the pre-processing module 252 where it receives heat from the supply air. The return air is then channeled through the fan 276 and toward the dampers 272, 273, and 275 (shown in FIG. 20). The dampers 273 and 275 are closed in the summer mode 280. The damper 272 is open in the summer mode 280 to channel the return air to the return air heat exchanger 264. In the summer mode 280, the return air heat exchanger 264 operates as a condenser coil to heat, lower relative humidity of the return air and increase the air's capacity to absorb water downstream. The return air then flows to the processing module 254 where moisture absorbed from the supply air is discharged into the return air to humidify the return air. Return air discharged from the processing module 254 flows into a duct 279. The duct 279 extends between the processing module 254 and the wall extending downward from the supply air heat exchanger 256. The duct 279 discharges the return air through damper 277 and through the return air outlet 268.

Referring to FIGS. 19-21, the winter mode 282 of the system 250 is illustrated. The supply air flow path 262 follows the same path as defined in the summer mode 280. In the winter mode 282 the function of the system components may differ from the function of the system components in the summer mode 280. The supply air flow path 262 begins at the supply air inlet 258 and flows into the pre-processing module 252 where heat from the return air flow path 290 is discharged into the supply air flow path 262. The supply air discharged from the pre-processing module 252 flows though the supply air heat exchanger 256. In the winter mode 282, the supply air heat exchanger 256 operates as a condenser coil to heat, lower relative humidity of the supply air and increase the air's capacity to absorb moisture downstream. The supply air then flows through the processing module 254 where the supply air is humidified with moisture discharged from the return air flow path 290. The fan 274 directs the supply air from the processing module 254 to the supply air outlet 260 and into the space.

The return air flow path 290 of the winter mode 282 differs from the return air flow path 270 of the summer mode 280. The dampers 272, 273, 275, and 277 are opened and/or closed to change the return air flow path 270 of the summer mode 280 to the return air flow path 290 of the winter mode 282. Return air is channeled into the return air flow path 290 through the return air inlet 266. The return air flows through the pre-processing module 252 where it discharges heat into the supply air flow path 262. The return air then flows through the fan 276 to the dampers 272, 273, and 275. In the winter mode 282, damper 272 is closed and damper 275 is opened to channel the return air to a duct 278. The duct 278 directs the return air to the processing module 254 where moisture is absorbed from the return air flow path 290 and discharged into the supply air flow path 262. The return air discharged from the processing module 254 is channeled to the return air heat exchanger 264. In the winter mode 282, the return air heat exchanger 264 operates as an evaporator coil to cool the return air. Damper 273 is opened in the winter mode 282 so that the return air discharged from the return air heat exchanger 264 flows through damper 273 and is discharged through the return air outlet 292.

The embodiments described herein utilize a pre-processing module in both summer and winter modes for energy recovery. The embodiments further utilize a processing module for both dehumidification in the summer mode and humidification in the winter mode. Additionally, in the winter mode the processing module dehumidifies the return air, by reduction of grains in moisture and an increase in sensible dry bulb temperature, prior to the return air entering the cooling coil in the air source heat pump. The return air is first dehumidified by entering the pre-processing module, where the source air is heated and humidified. The return air is further dehumidified prior to entering the evaporator coil by the processing module. Additionally, as the return air is dehumidified by the processing module, the dry bulb temperature of the return air is increased which increases the efficiency of the heat pump. The evaporator can then run at lower temperatures without freezing the evaporator fins. In winter mode the energy in the return air is used in the reverse air source heat pump cycle.

Additionally, in the embodiments described herein, supply air is humidified by both the pre-processing module and the processing module to reduce humidification load requirements and energy consumption for the buildings in the winter mode. The embodiments also provide an efficient air source heat pump for winter heating in lieu of electric, gas, HW, or stream. The return air also provides stable and optimum regenerative air temperatures and conditions for the processing module reactivation in the summer mode.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A heat pump system for conditioning air supplied to a space, the system configured to operate in both a summer mode and a winter mode, the system comprising:

a return air path including: a return air inlet, a first return air outlet downstream of the return air inlet, and a second return air outlet downstream of the return air inlet;

a supply air path including a supply air inlet and a supply air outlet downstream of the supply air inlet;

a supply air heat exchanger in the supply air path configured to operate as an evaporator coil in the summer mode and as a condenser coil in the winter mode;

a processing module spanning the return air path and the supply air path, the processing module in flow communication with the supply air heat exchanger downstream of the supply air heat exchanger, the processing module to condition air discharged into the space;

a pre-processing module spanning the return air path and the supply air path, the pre-processing module located upstream of the supply air heat exchanger in the supply air path and upstream of the return air heat exchanger and the pre-processing module in the return air path, the pre-processing module configured to cool the supply air by transferring heat from the return air in the summer mode and configured to heat the supply air by transferring heat from the return air in the winter mode, and at least one damper configured to change the flow of return air from the space between the summer mode and the winter mode, wherein the at least one damper is one of opened or closed during the summer mode so that return air passes through the processing module after passing through a return air heat exchanger and to the first return air outlet, and wherein the at least one damper is the other of opened or closed during the winter mode so that the return air passes through the processing module before passing through the return air heat exchanger and to the second return air outlet; and wherein the supply air heat exchanger discharges air having a lowered relative humidity to the processing module in the winter mode.

2. The heat pump system of claim 1 further comprising a pre-processing module in flow communication with the supply air heat exchanger, the pre-processing module receiving and preconditioning the supply air.

3. The heat pump system of claim 2, wherein moisture is transferred between the supply air and return air through the pre-processing module.

4. The heat pump system of claim 2, wherein at least one of the pre-processing module or the processing module is formed as at least one of a desiccant transfer pad or a liquid desiccant transfer system.

5. The heat pump system of claim 2, wherein at least one of the pre-processing module or processing module is formed as a rotating body.

6. The heat pump system of claim 5, wherein the rotating body is rotated with at least one of a pre-determined speed or a predetermined range to achieve a pre-determined amount of at least one of moisture transfer or heat transfer to limit frost formation in at least one of the pre-processing module or the return air heat exchanger.

7. The heat pump system of claim 5, wherein a rotational speed of at least one of the pre-processing module or the processing module is adjusted to a predetermined range, such that the pre-processing module or the processing module operates as at least one of a sensible wheel, a enthalpy wheel or a desiccant wheel based on variations in a supply air stream or a return air stream.

8. The heat pump system of claim 1, wherein the processing module is positioned downstream from the supply air heat exchanger.

9. The heat pump system of claim 1, wherein the supply air heat exchanger discharges heated supply air to the processing module in the winter mode.

10. The heat pump system of claim 1, wherein the supply air heat exchanger discharges conditioned supply air to the processing module in the winter mode.

11. The heat pump system of claim 1, wherein the system dehumidifies the supply air in the summer mode and humidifies the supply air in the winter.

12. The heat pump system of claim 1, wherein the return air heat exchanger operates as an evaporator coil in the winter mode and as a condenser coil in the summer mode.

13. The heat pump system of claim 1, wherein heat is transferred between the supply air heat exchanger and the return air heat exchanger.

14. The heat pump system of claim 1, wherein moisture is transferred between the supply air and the return air through the processing module.

15. The heat pump system of claim 1, wherein the return air from the space is utilized to at least one of humidify or condition the supply air.

16. The heat pump system of claim 1, wherein the return air from the space is utilized to regenerate the processing module.

17. The heat pump system of claim 1, wherein the return air from the space is dehumidified by the processing module during the winter mode.

18. The heat pump system of claim 1, wherein the processing module is formed as a rotating body.

19. The heat pump system of claim 18, wherein a rotational speed of the processing module is adjusted to a predetermined range, such that the processing module operates as at least one of a sensible wheel, an enthalpy wheel or a desiccant wheel based on variations in a supply air stream or a return air stream.

* * * * *